US008010362B2

(12) United States Patent
Tamura et al.

(10) Patent No.: US 8,010,362 B2
(45) Date of Patent: Aug. 30, 2011

(54) VOICE CONVERSION USING INTERPOLATED SPEECH UNIT START AND END-TIME CONVERSION RULE MATRICES AND SPECTRAL COMPENSATION ON ITS SPECTRAL PARAMETER VECTOR

(75) Inventors: Masatsune Tamura, Kanagawa-ken (JP); Takehiro Kagoshima, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 873 days.

(21) Appl. No.: 12/017,740

(22) Filed: Jan. 22, 2008

(65) Prior Publication Data

US 2008/0201150 A1 Aug. 21, 2008

(30) Foreign Application Priority Data

Feb. 20, 2007 (JP) ..... 2007-039673

(51) Int. Cl.
*G10L 13/06* (2006.01)
*G10L 13/00* (2006.01)

(52) U.S. Cl. ..... 704/265; 704/266

(58) Field of Classification Search ..... None
See application file for complete search history.

(56) References Cited

U.S. PATENT DOCUMENTS 5,327,521 A * 7/1994 Savic et al. ..... 704/272
6,236,963 B1 * 5/2001 Naito et al. ..... 704/241
6,336,092 B1 * 1/2002 Gibson et al. ..... 704/268
6,615,174 B1 * 9/2003 Arslan et al. ..... 704/270
6,836,761 B1 * 12/2004 Kawashima et al. ..... 704/258
6,915,261 B2 * 7/2005 Barile ..... 704/265
6,950,799 B2 * 9/2005 Bi et al. ..... 704/261
7,149,682 B2 * 12/2006 Yoshioka et al. ..... 704/205
7,464,034 B2 * 12/2008 Kawashima et al. ..... 704/266
7,606,709 B2 * 10/2009 Yoshioka et al. ..... 704/258

(Continued)

FOREIGN PATENT DOCUMENTS

JP 2002-215198 7/2002

OTHER PUBLICATIONS

Stylianou et al, Continuous Probabilistic Transform for Voice Conversion, IEEE Trans. Speech and Audio Processing, Mar. 1998, vol. 6, No. 2.

Tamura et al, Voice Conversion for Plural Speech with Selection and Fusion Based Speech Synthesis, Mar. 2006.

*Primary Examiner* — Talivaldis Ivars Smits
(74) *Attorney, Agent, or Firm* — Turocy & Watson, LLP

(57) ABSTRACT

A voice conversion rule and a rule selection parameter are stored. The voice conversion rule converts a spectral parameter vector of a source speaker to a spectral parameter vector of a target speaker. The rule selection parameter represents the spectral parameter vector of the source speaker. A first voice conversion rule of start time and a second voice conversion rule of end time in a speech unit of the source speaker are selected by the spectral parameter vector of the start time and the end time. An interpolation coefficient corresponding to the spectral parameter vector of each time in the speech unit is calculated by the first voice conversion rule and the second voice conversion rule. A third voice conversion rule corresponding to the spectral parameter vector of each time in the speech unit is calculated by interpolating the first voice conversion rule and the second voice conversion rule with the interpolation coefficient. The spectral parameter vector of each time is converted to a spectral parameter vector of the target speaker by the third voice conversion rule. A spectrum acquired from the spectral parameter vector of the target speaker is compensated by a spectral compensation filter or power ratio. A speech waveform is generated from the compensated spectrum.

18 Claims, 27 Drawing Sheets

U.S. PATENT DOCUMENTS 7,643,988 B2 * 1/2010 En-Najjary et al. ..... 704/207
7,664,645 B2 * 2/2010 Hain et al. ..... 704/269
7,765,101 B2 * 7/2010 En-Najjary et al. ..... 704/246
7,792,672 B2 * 9/2010 Rosec et al. ..... 704/246
2005/0137870 A1 6/2005 Mizutani et al.
2007/0168189 A1 7/2007 Tamura et al.

* cited by examiner

11

| REGRESSION MATRIX | PROBABILITY DISTRIBUTION |
|---|---|
| $W_1$ | $p_1(x) = N(x \mid \mu_1, \Sigma_1)$ |
| $W_2$ | $p_2(x) = N(x \mid \mu_2, \Sigma_2)$ |
| $\vdots$ | $\vdots$ |
| $W_K$ | $p_K(x) = N(x \mid \mu_K, \Sigma_K)$ |

FIG. 6

| SPEECH UNIT NUMBER | SPEECH UNIT WAVEFORM |
|---|---|
| 0 | |
| 1 | |
| 2 | |
| ⋮ | ⋮ |

FIG. 15A

| UNIT NUMBER | PHONEME (HALF PHONEME NAME) | BASIC FREQUENCY (Hz) | PHONEME DURATION (msec) | CONNECTION BOUNDARY CEPSTRUM | PHONEME ENVIRONMENT |
|---|---|---|---|---|---|
| 0 | /a-left/ | 308.6 | 74.0 | $C_0(1), C_0(T)$ | m-a-k |
| 1 | /a-right/ | 300.5 | 65.4 | $C_1(1), C_1(T)$ | n-a-d |
| 2 | /i-left/ | 334.6 | 69.5 | $C_2(1), C_2(T)$ | a-i-s |
| : | : | : | : | : | : |

FIG. 15B

| REGRESSION MATRIX | TYPICAL SPECTRAL PARAMETER VECTOR |
|---|---|
| $W_1$ | $c_1$ |
| $W_2$ | $c_2$ |
| ⋮ | ⋮ |
| $W_K$ | $c_K$ |

VOICE CONVERSION USING INTERPOLATED SPEECH UNIT START AND END-TIME CONVERSION RULE MATRICES AND SPECTRAL COMPENSATION ON ITS SPECTRAL PARAMETER VECTOR

CROSS-REFERENCE TO RELATED APPLICATIONS

This application is based upon and claims the benefit of priority from prior Japanese Patent Application No. 2007-39673, filed on Feb. 20, 2007; the entire contents of which are incorporated herein by reference.

FIELD OF THE INVENTION

The present invention relates to a voice conversion apparatus for converting a source speaker's speech to a target speaker's speech and a speech synthesis apparatus having the voice conversion apparatus.

BACKGROUND OF THE INVENTION

Technique to convert a speech of a source speaker's voice to the speech of a target speaker's voice is called "voice conversion technique". As to the voice conversion technique, spectral information of speech is represented as a parameter, and a voice conversion rule is trained (determined) from the relationship between a spectral parameter of a source speaker and a spectral parameter of a target speaker. Then, a spectral parameter is calculated by analyzing an arbitrary input speech of the source speaker, and the spectral parameter is converted to a spectral parameter of the target speaker by applying the voice conversion rule. By synthesizing speech waveforms from the spectral parameter of the target speaker, the voice of the input speech is converted to the target speaker's voice.

As one method for converting voice, a voice conversion algorithm based on Gaussian mixture model (GMM) is disclosed in "Continuous Probabilistic Transform for Voice Conversion, Y. Stylianou et al., IEEE Transactions on Speech and Audio Processing, Vol. 6, No. 2, March 1998" (non-patent reference 1). In this algorithm, GMM is calculated from a spectral parameter of a source speaker's speech, a regression matrix of each mixture of GMM is calculated by regressively analyzing a pair of the source speaker's spectral parameter and the target speaker's spectral parameter, and the regression matrix is set as a voice conversion rule.

In case of applying the voice conversion rule, a regression matrix is weighted with a probability that spectral parameter of the source speaker's speech is output at each mixture of GMM, and a spectral parameter of the target speaker's voice is obtained using the regression matrix. Calculation of weighted sum by output probability of GMM is regarded as interpolation of regressive analysis based on likelihood of GMM. However, in this case, a spectral parameter is not always interpolated along temporal direction of speech, and spectral parameters smoothly adjacent are not always smoothly adjacent after conversion.

Furthermore, Japanese Patent No. 3703394 discloses a voice conversion apparatus by interpolating a spectral envelope conversion rule of a transition section (patent reference 1). In the transition section between phonemes, a spectral envelope conversion rule is interpolated, so that a spectral envelope conversion rule of a previous phoneme of the transition section is smoothly transformed to a spectral envelope conversion rule of a next phoneme of the transition section.

In the patent reference 1, straight line-interpolation of spectral envelope conversion rule is disclosed. However, this method is not based on assumption that the spectral envelope conversion rule is interpolated along temporal direction in case of training the conversion rule. Briefly, interpolation method for conversion rule training is not matched with interpolation method for actual conversion processing. Furthermore, speech temporal change is not always straight, and quality of converted voice often falls. Even if the conversion rule is trained based on above assumption, restriction for parameter of the conversion rule increases during training. As a result, estimation accuracy of the conversion rule falls, and similarity between the converted voice and the target speaker's voice also falls.

Artificial generation of a speech signal from an arbitrary sentence is called "text speech synthesis". In general, the text speech synthesis includes three steps of language processing, prosody processing, and speech synthesis. First, a language processing section morphologically and semantically analyzes an input text. Next, a prosody processing section processes accent and intonation of the text based on the analysis result, and outputs a phoneme sequence/prosodic information (fundamental frequency, phoneme segmental duration). Last, speech synthesis section synthesizes a speech waveform based on the phoneme sequence/prosodic information. As one speech synthesis method, by setting input phoneme sequence/prosodic information as a target, a speech synthesis method of unit selection type for selecting a speech unit sequence from a speech unit database (storing a large number of speech units) and for synthesizing the speech unit sequence is known. In this method, a plurality of speech units is selected from the large number of speech units (previously stored) based on input phoneme sequence/prosodic information, and a speech is synthesized by concatenating the plurality of speech units.

Furthermore, a speech synthesis method of plural unit selection type is also known. In this method, by setting input phoneme sequence/prosodic information as a target, as to each synthesis unit of the input phoneme sequence, a plurality of speech units is selected based on distortion of a synthesized speech, a new speech unit is generated by fusing the plurality of speech units, and a speech is synthesized by concatenating fused speech units. As a fusion method, for example, a pitch waveform is averaged.

As above-mentioned unit selection types, using a small number of speech data of a target speaker, a method for converting speech units (stored in a database of text speech synthesis) is disclosed in "Voice conversion for plural speech unit selection and fusion based speech synthesis, M. Tamura et al., Spring meeting, Acoustic Society of Japan, 1-4-13, March 2006" (non-patent reference 2). In this reference, a voice conversion rule is trained using a large number of speech data of a source speaker and a small number of speech data, and an arbitrary sentence with voice of the target speaker is synthesized by applying the voice conversion rule to a speech unit database of the source speaker. However, the voice conversion rule is based on the method in the non-patent reference 1. Accordingly, in the same way as the non-patent reference 1, a converted spectral parameter is not always smooth in temporal direction.

In the non-patent references 1 and 2, a voice conversion rule based on a model is created while training the conversion rule. However, the conversion rule is not always interpolated (not always smooth) along the temporal direction.

In the patent reference 1, a voice at a transition section is smoothly converted along temporal direction. However, this method is not based on the assumption that a conversion rule is interpolated along temporal direction while training the conversion rule. Briefly, the interpolation method for training the conversion rule is not matched to the interpolation method for actual conversion processing. Furthermore, speech temporal change is not always straight, and quality of converted voice often falls. Even if the conversion rule is trained based on above assumption, restriction for parameter of the conversion rule increases during training. As a result, estimation accuracy of the conversion rule falls, and similarity between the converted voice and the target speaker's voice also falls.

SUMMARY OF THE INVENTION

The present invention is directed to a voice conversion apparatus and a method for smoothly converting a voice along the temporal direction with high similarity between a source speaker's voice and a target speaker's voice.

According to an aspect of the present invention, there is provided an apparatus for converting a source speaker's speech to a target speaker's speech, comprising: a speech unit generation section configured to acquire speech units of the source speaker by segmenting the source speaker's speech; a parameter calculation section configured to calculate spectral parameter vectors of each time in a speech unit, the each time being a predetermined time between a start time and an end time of the speech unit; a conversion rule memory configured to store voice conversion rules and rule selection parameters each corresponding to a voice conversion rule, the voice conversion rule converting a spectral parameter vector of the source speaker to a spectral parameter vector of the target speaker, a rule selection parameter representing a feature of the spectral parameter vector of the source speaker; a rule selection section configured to select a first voice conversion rule corresponding to a first rule selection parameter and a second voice conversion rule corresponding to a second rule selection parameter from the conversion rule memory, the first rule selection parameter being matched with a first spectral parameter vector of the start time, the second rule selection parameter vector being matched with a second spectral parameter of the end time; an interpolation coefficient decision section configured to determine interpolation coefficients each corresponding to a third spectral parameter vector of the each time in the speech unit based on the first voice conversion rule and the second voice conversion rule; a conversion rule generation section configured to generate third voice conversion rules each corresponding to the third spectral parameter vector of the each time in the speech unit by interpolating the first voice conversion rule and the second conversion rule with each of the interpolation coefficients; a spectral parameter conversion section configured to respectively convert the third spectral parameter vector of the each time to a spectral parameter vector of the target speaker based on each of the third voice conversion rules; a spectral compensation section configured to compensate a spectrum acquired from the converted spectral parameter of the target speaker by a spectral compensation filter or power ratio; and a speech waveform generation section configured to generate a speech waveform from the compensated spectrum.

According to another aspect of the present invention, there is also provided a method for converting a source speaker's speech to a target speaker's speech, comprising: storing voice conversion rules and rule selection parameters each corresponding to a voice conversion rule in a memory, the voice conversion rule converting a spectral parameter vector of the source speaker to a spectral parameter vector of the target speaker, a rule selection parameter representing a feature of the spectral parameter vector of the source speaker; acquiring speech units of the source speaker by segmenting the source speaker's speech; calculating spectral parameter vectors of each time in a speech unit, the each time being a predetermined time between a start time and an end time of the speech unit; selecting a first voice conversion rule corresponding to a first rule selection parameter and a second voice conversion rule corresponding to a second rule selection parameter from the memory, the first rule selection parameter being matched with a first spectral parameter vector of the start time, the second rule selection parameter being matched with a second spectral parameter vector of the end time; determining interpolation coefficients each corresponding to a third spectral parameter vector of the each time in the speech unit based on the first voice conversion rule and the second voice conversion rule; generating third voice conversion rules each corresponding to the third spectral parameter vector of the each time in the speech unit by interpolating the first voice conversion rule and the second voice conversion rule with each of the interpolation coefficients; converting the third spectral parameter vector of the each time to a spectral parameter vector of the target speaker based on each of the third voice conversion rules; compensating a spectrum acquired from the converted spectral parameter vector of the target speaker by a spectral compensation filter or power ratio; and generating a speech waveform from the compensated spectrum.

According to still another aspect of the present invention, there is also provided a computer readable memory device storing program codes for causing a computer to convert a source speaker's speech to a target speaker's speech, the program codes comprising: a first program code to correspondingly store voice conversion rules and rule selection parameters each corresponding to a voice conversion rule in a memory, the voice conversion rule converting a spectral parameter vector of the source speaker to a spectral parameter vector of the target speaker, a rule selection parameter representing a feature of the spectral parameter vector of the source speaker; a second program code to acquire speech units of the source speaker by segmenting the source speaker's speech; a third program code to calculate spectral parameter vectors of each time in a speech unit, the each time being a predetermined time between a start time and an end time of the speech unit; a fourth program code to select a first voice conversion rule corresponding to a first rule selection parameter and a second voice conversion rule corresponding to a second rule selection parameter from the memory, the first rule selection parameter being matched with a first spectral parameter vector of the start time, the second rule selection parameter being matched with a second spectral parameter vector of the end time; a fifth program code to decide interpolation coefficients each corresponding to a third spectral parameter vector of the each time in the speech unit based on the first voice conversion rule and the second voice conversion rule; a sixth program code to generate third voice conversion rules each corresponding to the third spectral parameter vector of the each time in the speech unit by interpolating the first voice conversion rule and the second voice conversion rule with each of the interpolation coefficients; a seventh program code to convert the third spectral parameter vector of the each time to a spectral parameter vector of the target speaker based on each of the third voice conversion rules; an eighth program code to compensate a spectrum acquired from the converted spectral parameter of the target speaker by a spectral compensation filter or power ratio; and a ninth program code to generate a speech waveform from the compensated spectrum.

BRIEF DESCRIPTION OF THE DRAWINGS

FIG. 6 is a schematic diagram of an example of a voice conversion rule memory 11 in FIG. 1.

FIGS. 15A and 15B are schematic diagrams of waveform information and attribute information in a source speaker speech unit database in FIG. 13.

DETAILED DESCRIPTION OF THE EMBODIMENTS

Figure 1:
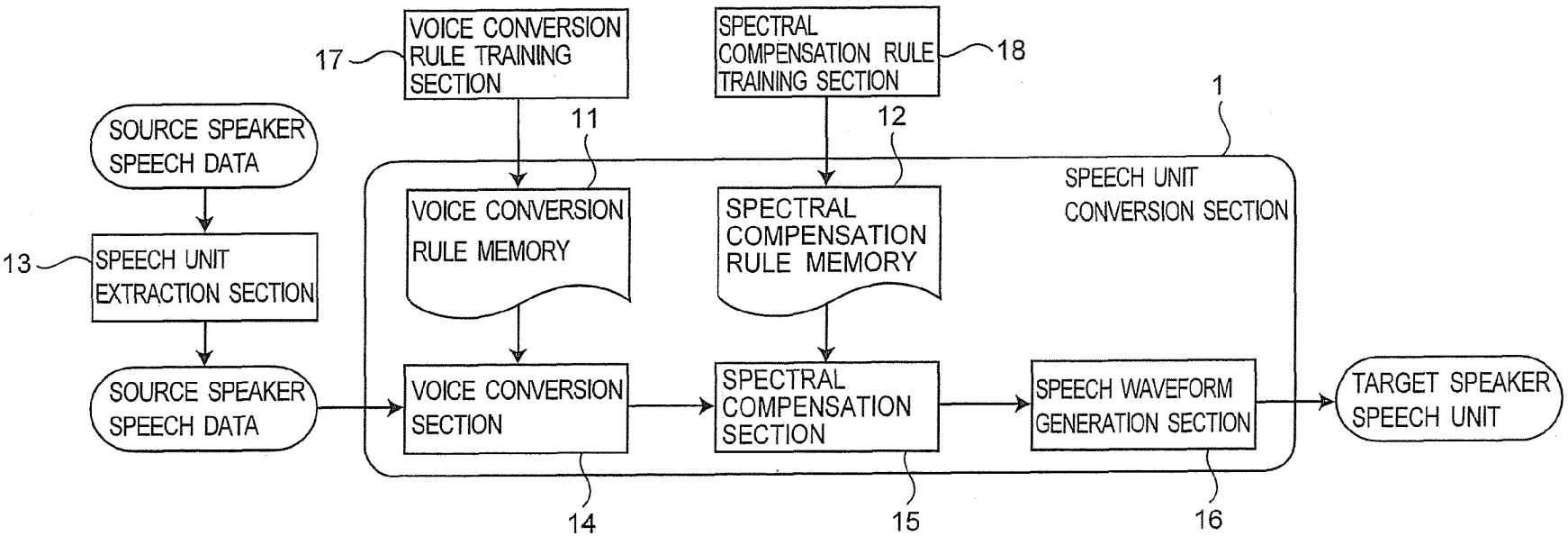
FIG. 1 is a block diagram of a voice conversion apparatus according to a first embodiment.

Hereinafter, various embodiments of the present invention will be explained by referring to the drawings. The present invention is not limited to the following embodiments.

First Embodiment

A voice conversion apparatus of the first embodiment is explained by referring to FIGS. 1~22.

(1) Component of the Voice Conversion Apparatus

FIG. 1 is a block diagram of the voice conversion apparatus according to the first embodiment. In the first embodiment, a speech unit conversion section 1 converts speech units from a source speaker's voice to a target speaker's voice.

As shown in FIG. 1, the speech unit conversion section 1 includes a voice conversion rule memory 11, a spectral compensation rule memory 12, a voice conversion section 14, a spectral compensation section 15, and a speech waveform generation section 16.

A speech unit extraction section 13 extracts speech units of a source speaker from source speaker speech data. The voice conversion rule memory 11 stores a rule to convert a speech parameter of a source speaker (source speaker spectral parameter) to a speech parameter of a target speaker (target speaker spectral parameter). This rule is created by a voice conversion rule training section 17.

The spectral compensation rule memory 12 stores a rule to compensate a spectral of converted speech parameter. This rule is created by a spectral compensation rule training section 18.

The voice conversion section 14 applies each speech parameter of source speaker's speech unit with a voice conversion rule, and generates a target speaker's voice of the speech unit.

The spectral compensation section 15 compensates a spectral of converted speech parameter by a spectral compensation rule stored in the spectral compensation rule memory 12.

The speech waveform generation section 16 generates a speech waveform from the compensated spectral, and obtains speech units of the target speaker.

(2) Voice Conversion Section 14

Figure 2:
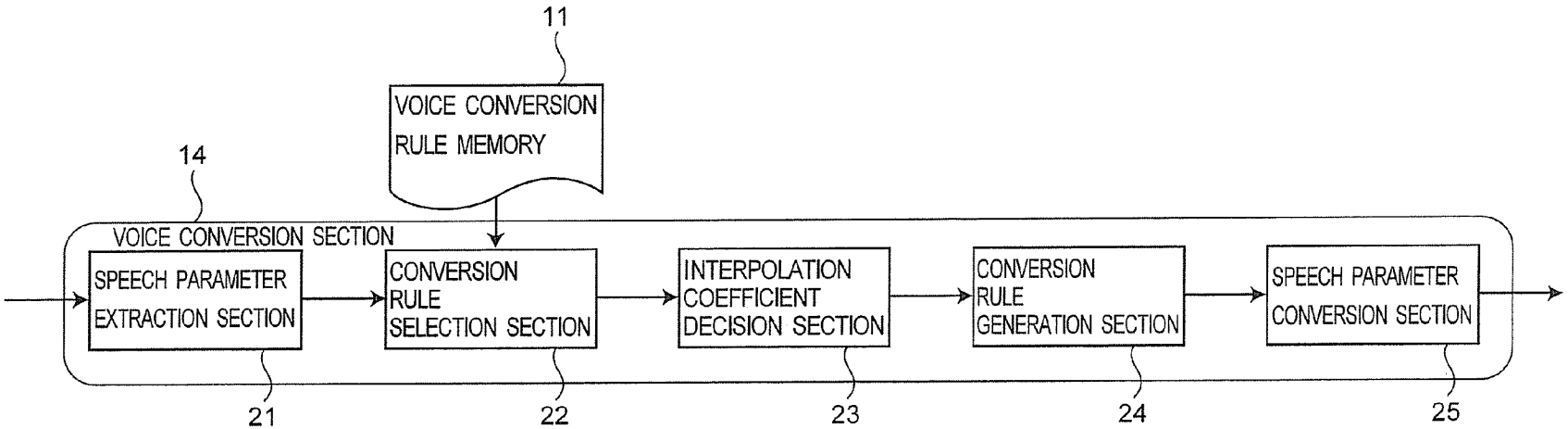
FIG. 2 is a block diagram of a voice conversion section 14 in FIG. 1.

(2-1) Component of the Voice Conversion Section 14:

As shown in FIG. 2, the voice conversion section 14 includes a speech parameter extraction section 21, a conversion rule selection section 22, an interpolation coefficient decision section 23, a conversion rule generation section 24, and a speech parameter conversion section 25.

The speech parameter extraction section 21 extracts a spectral parameter from a speech unit of a source speaker. The conversion rule selection section 22 selects two voice conversion rules corresponding to two spectral parameters of a start point and an end point in the speech unit from the voice conversion rule memory 11, and sets the two voice conversion rules as a start point conversion rule and an end point conversion rule. The interpolation coefficient decision section 23 decides an interpolation coefficient of a speech parameter of each timing in the speech unit. The conversion rule generation section 24 interpolates the start point conversion rule and the end point conversion rule by the interpolation coefficient of each timing, and generates a voice conversion rule corresponding to the speech parameter of each timing. The speech parameter conversion section 25 acquires a speech parameter of a target speaker by applying the generated voice conversion rule.

(2-2) Processing of the Voice Conversion Section 14:

Hereinafter, detail processing of the voice conversion section 14 is explained. A speech unit of a source speaker (as an input to the voice conversion section 14) is acquired by segmenting speech data of the source speaker to each speech unit (by the speech unit extraction section 13). A speech unit is a combination of phonemes or divided ones of the phoneme. For example, the speech unit is a half-phoneme, a phoneme (C,V), a diphone(CV,VC,VV), a triphone(CVC,VCV), a syllable(CV,V) (V: vowel, C: consonant). Alternatively, it may be a variable-length such as these combinations.

Figure 3:
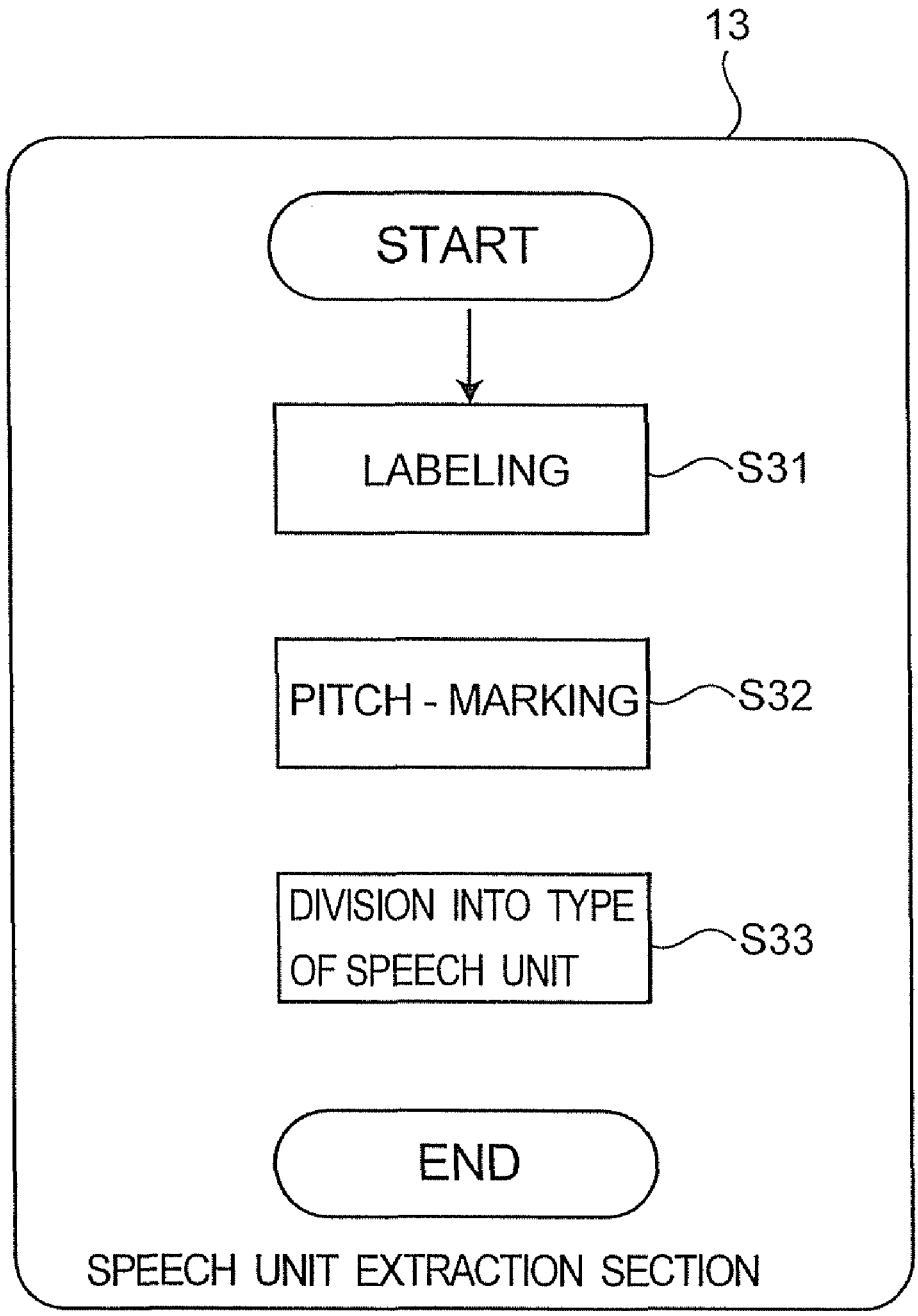
FIG. 3 is a flow chart of processing of a speech unit extraction section 12 in FIG. 1.

(2-2-1) The Speech Unit Extraction Section 13:

FIG. 3 is a flow chart of processing of the speech unit extraction section 13. At S31, a label such as a phoneme unit is assigned (labeled) to input speech data of a source speaker. At S32, a pitch-mark is assigned to the labeled speech data. At S33, the labeled speech data is segmented (divided) into a speech unit corresponding to a predetermined type.

Figure 4:
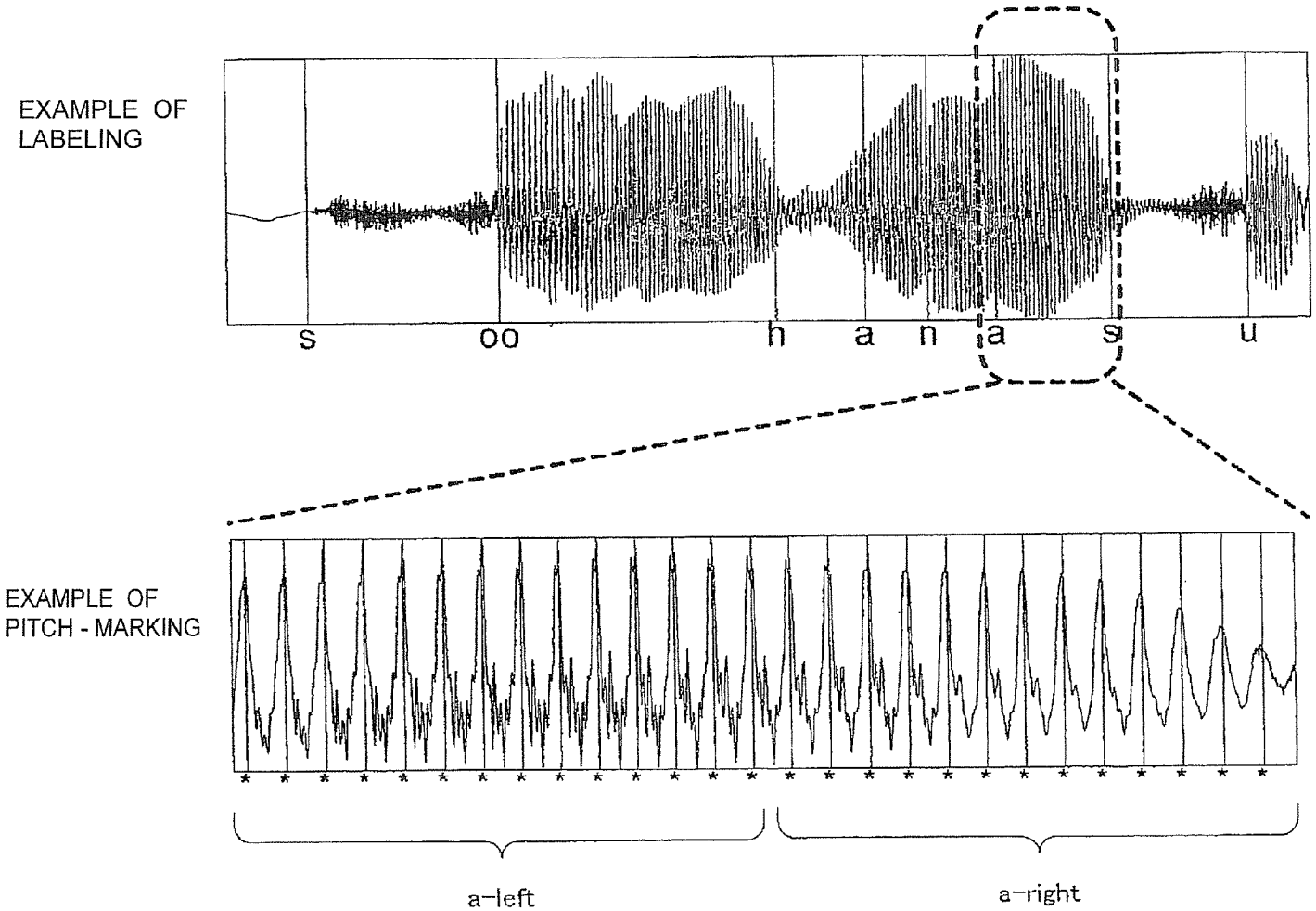
FIG. 4 is a schematic diagram of an example of labeling and pitch marking of the speech unit extraction section 12.

FIG. 4 shows example of labeling and pitch-marking for a phrase "Soohanasu". The upper part of FIG. 4 shows an example that a phoneme boundary of speech data is subjected to labeling. The lower part of FIG. 4 shows an example that the labeled phone boundary of speech data is subjected to pitch-marking.

"Labeling" means assignment of a label representing a boundary and a phoneme type of each speech unit, which is executed by a method using the hidden Markov model. The labeling may be artificially executed instead of automatic labeling.

"Pitch-marking" means assignment of a mark synchronized with a base period of speech, which is executed by a method for extracting a waveform peak.

In this way, the speech data is segmented to each speech unit. If the speech unit is a half-phoneme, a speech waveform is segmented by a phoneme boundary and a phoneme center. As shown in the lower part of FIG. 4, left unit of "a" (a-left) and right unit of "a" (a-right) are extracted.

Figure 5:
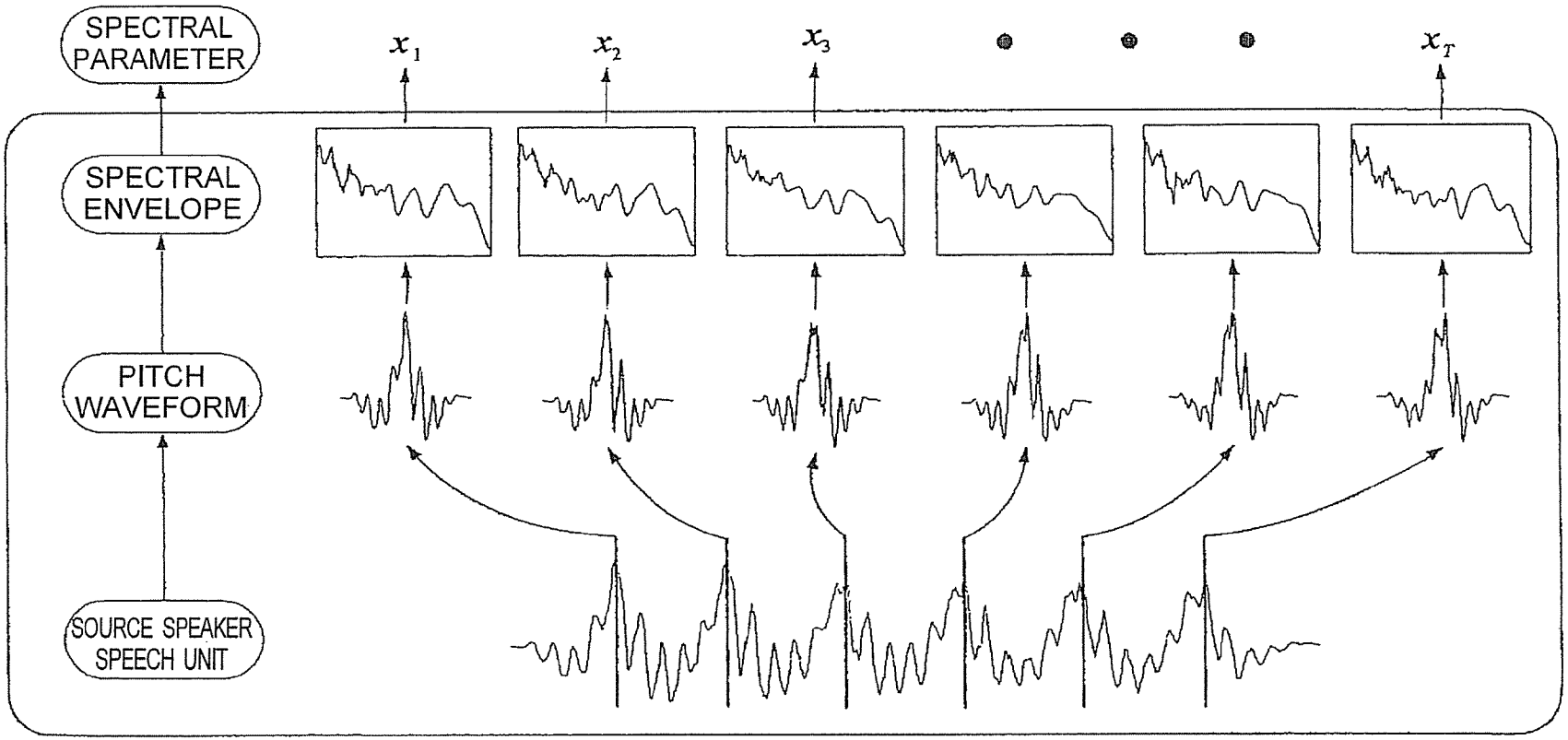
FIG. 5 is a schematic diagram of an example of a speech unit and a spectral parameter extracted from the speech unit.

(2-2-2) The Speech Parameter Extraction Section 21:

The speech parameter extraction section 21 extracts a spectral parameter from a speech unit of a source speaker. FIG. 5 shows one speech unit and its spectral parameter. In this case, the spectral parameter is acquired by pitch-synchronous analysis, and a spectral parameter is extracted from each pitch mark of speech unit.

First, a pitch waveform is extracted from a speech unit of the source speaker. Concretely, as a center of pitch mark, the pitch waveform is extracted by a Hanning window having double length of a pitch period onto the speech waveform. Next, the pitch waveform is subjected to spectral analysis, and a spectral parameter is extracted. The spectral parameter represents spectral envelope information of speech unit such as a LPC coefficient, a LSF parameter, or a mel-cepstrum.

The mel-cepstrum as one of spectral parameter is calculated by a method of regularized discrete cepstrum or a method of unbiased estimation. The former method is disclosed in "Regularization Techniques for Discrete Cepstrum Estimation, O. Capp et al., IEEE SIGNAL PROCESSING LETTERS, Vol. 3, No. 4, April 1996". The latter method is disclosed in "Cepstrum Analysis of Speech, Mel-Cepstrum Analysis, T. Kobayashi, The Institute of Electronics, Information and Communication Engineers, DSP98-77/SP98-56, pp 33-40, September 1998".

(2-2-3) The Conversion Rule Selection Section 22:

Next, the conversion rule selection section 22 selects voice conversion rules corresponding to a start point and an end point of the speech unit from the voice conversion rule memory 11. The voice conversion rule memory 11 stores a spectral parameter conversion rule and information to select the conversion rule. In this case, a regression matrix is used as the spectral parameter conversion rule, and a probability distribution of a source speaker's spectral parameter corresponding to the regression matrix is stored. The probability distribution is used for selection and interpolation of the regression matrix.

For example, in the voice conversion rule memory 11, a regression matrix $W_k$ (1=<k=<K) of k units and a probability distribution $p_k(x)$ (1=<k=<K) corresponding to the regression matrix are stored. The regression matrix is represented as a conversion from a spectral parameter of a source speaker to a spectral parameter of a target speaker. This conversion is represented using the regression matrix W as follows.

$$y=W\xi,\xi=(1,x^T)^T \tag{1}$$

(T: transposition of matrix)

In Equation (1), "X" Represents a Spectral Parameter of pitch waveform of the source speaker, "ξ" represents sum of "x" and offset item "1", and "y" represents the converted spectral parameter. If a number of dimension of the spectral parameter is p, W is a matrix having the number of dimensions p×(p+1).

As the probability distribution corresponding to each regression matrix, a Gaussian model having an average vector $\mu_k$ and a covariance matrix $\Sigma_k$ is used as follows.

$$p_k(x)=N(x|\mu_k,\Sigma_k) \tag{2}$$

(N(|):normal distribution)

As shown in FIG. 6, the voice conversion rule memory 11 stores the regression matrix $W_k$ of k units and the probability distribution $p_k(x)$. The conversion rule selection section 22 selects regression matrixes corresponding to a start point and an end point of a speech unit. Selection of the regression matrix is based on likelihood of the probability distribution. As shown in the upper side of FIG. 5, the speech unit has spectral parameter $x_t$ (1=<t=<T) of T units.

As to the regression matrix of the start point, a regression matrix $W_k$ corresponding to k of maximum $p_k(x_1)$ is selected. For example, by substituting $x_1$ for N, $p_t(x_1)$ having the highest likelihood is selected from $p_1(x_1)$~$p_k(x_1)$, and a regression matrix corresponding to $p_t(x_1)$ is selected. In the same way, as to the regression matrix of the endpoint, $P_t(x_T)$ having the highest likelihood is selected from $p_1(x_T)$~$p_k(x_T)$, and a regression matrix corresponding to $p_t(x_T)$ is selected. The selected matrixes are set as $W_s$ and $W_e$.

(2-2-4) The Interpolation Coefficient Decision Section 23:

Next, the interpolation coefficient decision section 23 calculates an interpolation coefficient of a conversion rule corresponding to a spectral parameter in the speech unit. The interpolation coefficient is determined based on the hidden Markov model (HMM). Determination of the interpolation coefficient using HMM is explained by referring to FIG. 7.

In the conversion rule selection section 22, a probability distribution corresponding to the start point is an output distribution of a first state, a probability distribution corresponding to the end point is an output distribution of a second state, and HMM corresponding to the speech unit is determined by a state transition probability.

As to the HMM having two states, a probability that spectral parameter of timing t of the speech unit is output at the first state is set as an interpolation coefficient of a regression matrix corresponding to the first state, a probability that spectral parameter of timing t of the speech unit is output at the second state is set as an interpolation coefficient of a regression matrix corresponding to the second state, and the regression matrix is interpolated with probability. This situation is represented by lattice points as shown in the center diagram of FIG. 7. Each lattice point in the upper line represents a probability that a vector of timing t is output at the first state as follows.

$$\gamma_t(1)=p(q_t=1|,X\lambda) \tag{3}$$

Each lattice point in the lower line represents a probability that a vector of timing t is output at the second state as follows.

$$\gamma_t(2)=p(q_t=2|,X,\lambda)=1-\gamma_1(x_t) \tag{4}$$

Figure 7:
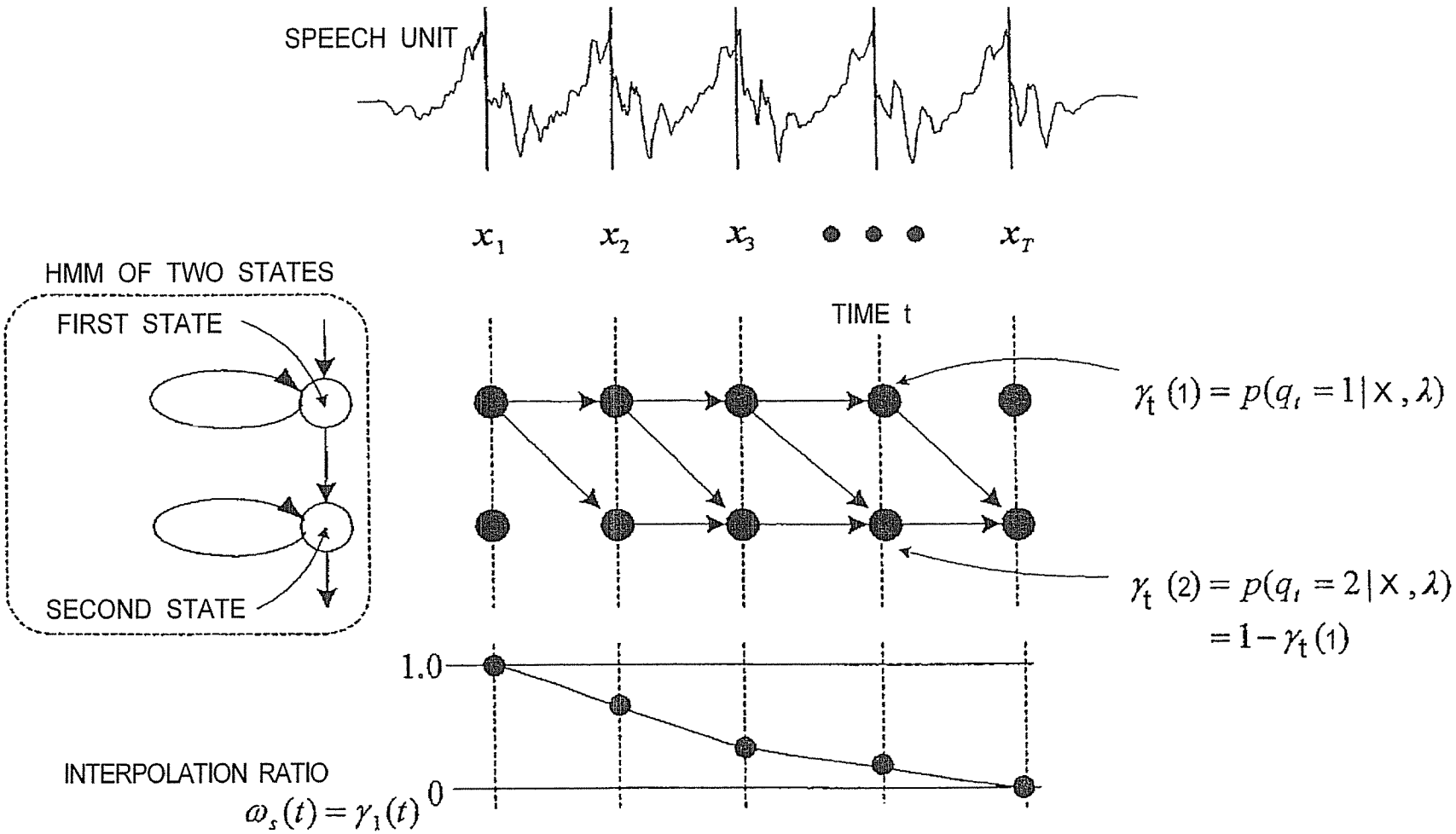
FIG. 7 is a schematic diagram of a processing example of the voice conversion section 14.

In the center diagram of FIG. 7, an arrow represents possible state transition, "$q_t$" represents a state of timing t, "λ" represents a model, and "X" represents a spectral parameter sequence $X=(x_1, x_2, \ldots, x_T)$ extracted from the speech unit. "$\gamma_t(i)$" is calculated by Forward-Backward algorithm of HMM. Actually, a forward probability that $x_t$ output from the parameter sequence $x_1$ exists in the state i at timing t is $\alpha_t(i)$, and a backward probability that $x_t$ exists in the state i at timing t and are output from timing $x_{t+1}$ to timing $x_T$ is $\beta_t(i)$. In this case, $\gamma_t(i)$ is represented as follows.

$$\gamma_t(i) = \frac{\alpha_t(i)\beta_t(i)}{\sum_{i=1}^{2} \alpha_t(i)\beta_t(i)} \tag{5}$$

In this way, the interpolation coefficient decision section 23 calculates $\gamma_t(1)$ as an interpolation coefficient $\omega_s(t)$ corresponding to a regression matrix of the start point, and calculates $\gamma_t(2)$ as an interpolation coefficient $\omega_e(t)$ corresponding to a regression matrix of the start point. The lower diagram of FIG. 7 shows the interpolation coefficient $\omega_s(t)$. In case of calculating the interpolation coefficient by the above method, as shown in the lower diagram of FIG. 7, $\omega_s(t)$ is 1.0 at the start point, gradually decreases with change of speech spectral, and is 0.0 at the end point.

(2-2-5) The Conversion Rule Generation Section 24:

In the conversion rule generation section 24, a regression matrix $W_s$ of the start point and a regression matrix $W_e$ of the end point in the speech unit are respectively interpolated by interpolation coefficients $\omega_s(t)$ and $\omega_e(t)$, and the regression matrix of each spectral parameter is calculated. A regression matrix W(t) of timing t is calculated as follows.

$$W(t)=\omega_s(t)W_s+\omega_e(t)W_e \tag{6}$$

Figure 8:
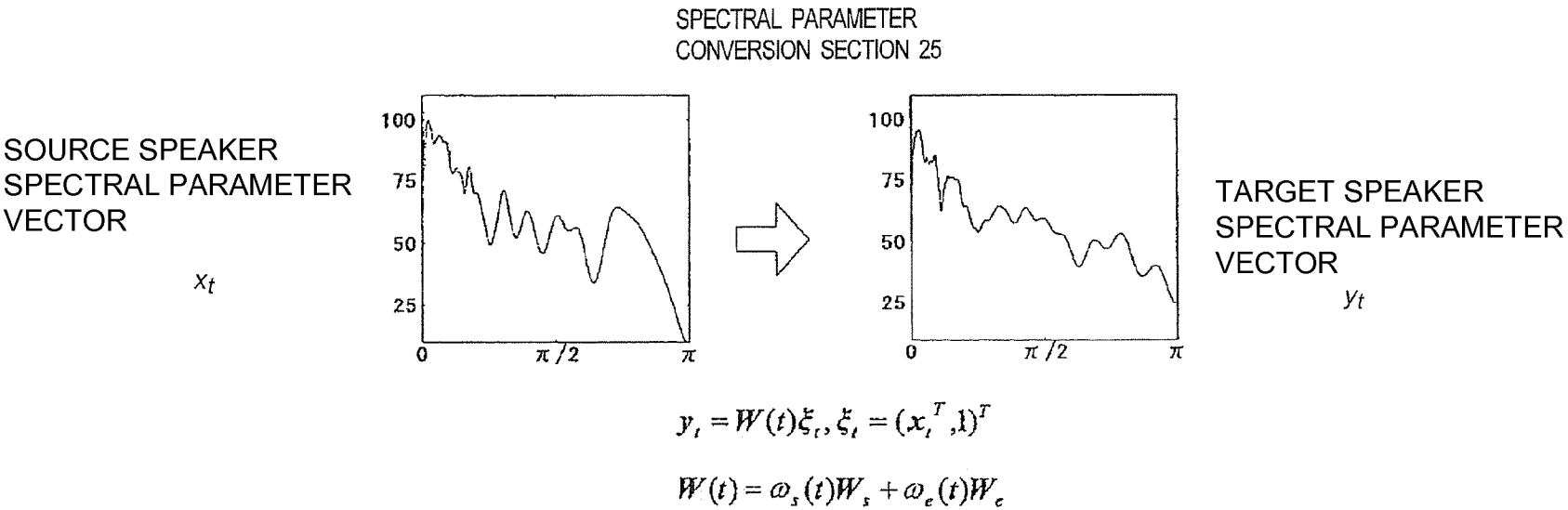
FIG. 8 is a schematic diagram of a processing example of a speech parameter conversion section 25 in FIG. 2.

(2-2-6) The Speech Parameter Conversion Section 25:

In the speech parameter conversion section 25, a speech parameter is actually converted using a conversion rule of the regression matrix. As shown in the equation (1), the speech parameter is converted by applying the regression matrix to a spectral parameter of the source speaker. FIG. 8 shows this processing situation. The regression matrix W(t) (calculated by the equation (6)) is applied to a spectral parameter $x_t$ of the source speaker of timing t, and a spectral parameter $y_t$ of a target speaker is calculated.

(2-3) Effect:

By above processing, the voice conversion section 14 converts a source speaker's voice by interpolating a speech unit with probability along temporal direction.

(3) The Spectral Compensation Section 15

Figure 9:
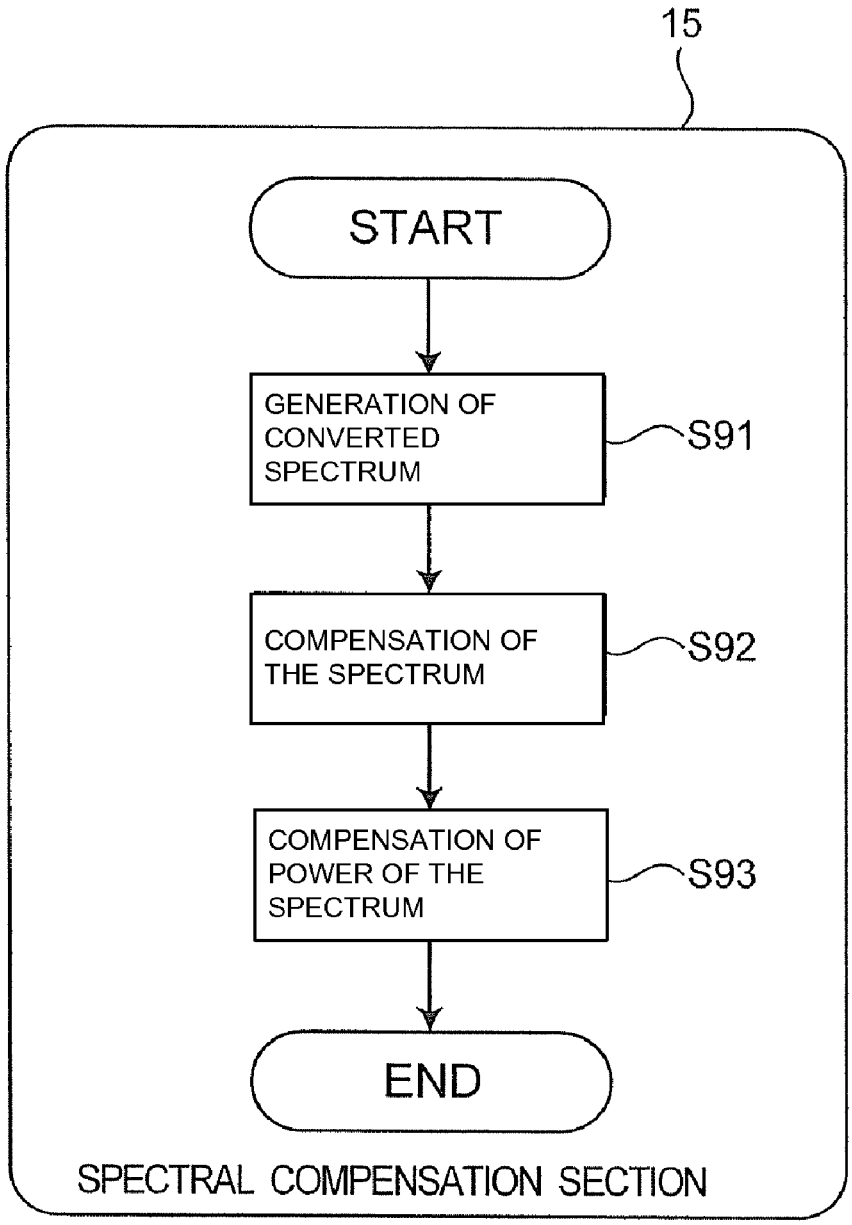
FIG. 9 is a flow chart of processing of a spectral compensation section 15 in FIG. 1.

Next, processing of the spectral compensation section 15 is explained. FIG. 9 is a flow chart of processing of the spectral compensation section 15. First, at S91, a converted spectral (a target spectral) is acquired from a spectral parameter of a target speaker (output from the voice conversion section 14).

Figure 10:
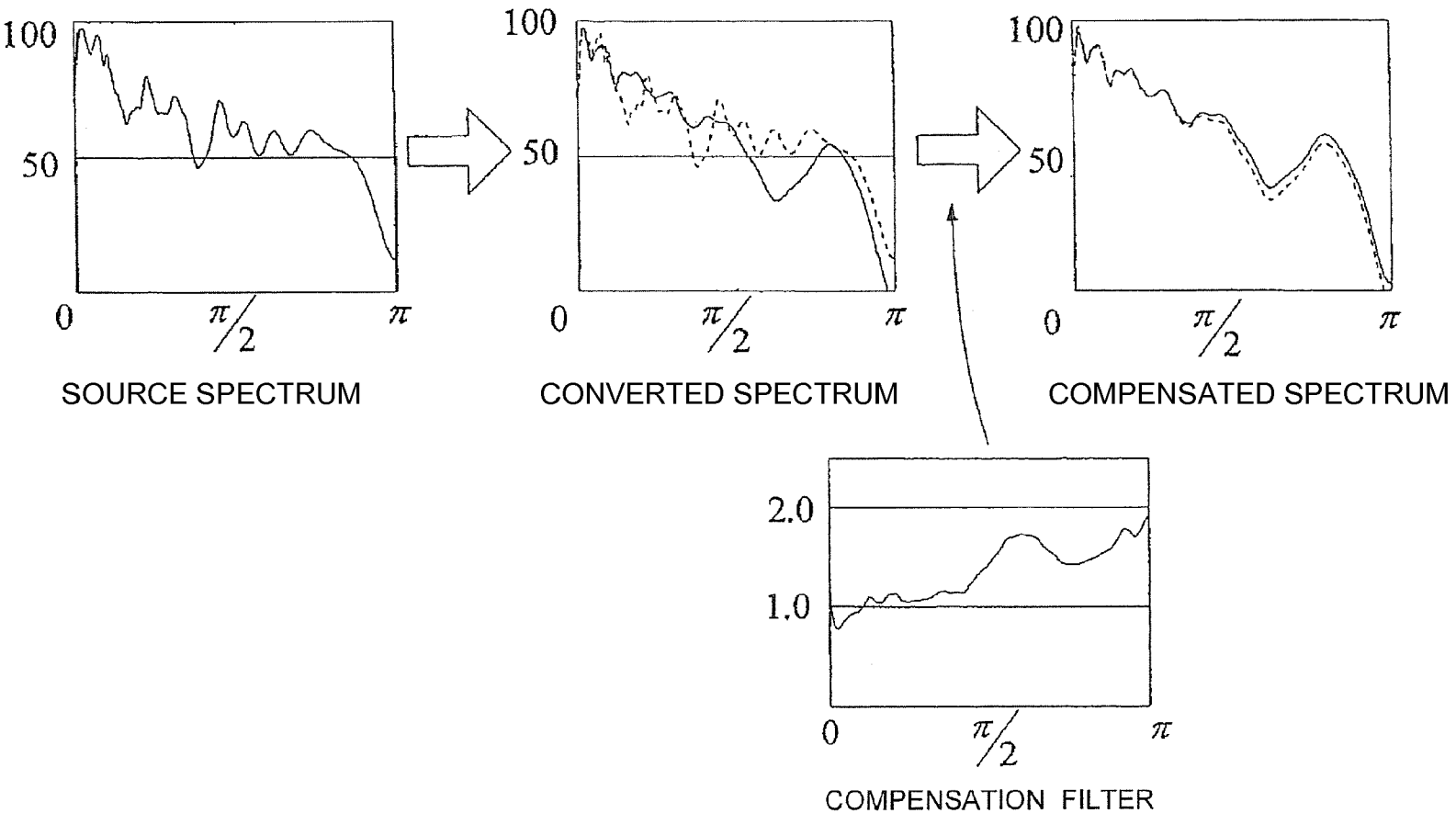
FIG. 10 is a block diagram of a processing example of the spectral compensation section 15.

At S92, the converted spectral is compensated by a spectral compensation rule (stored in the spectral compensation rule memory 12), and a compensated spectral is acquired. Compensation of spectral is executed by applying a compensation filter to the converted vector. The compensation filter $H(e_{j\omega})$ is previously generated by the spectral compensation rule training section 19. FIG. 10 shows an example of spectral compensation.

In FIG. 10, the compensation filter represents a ratio of an average spectral of the source speaker to an average spectral calculated from a spectral parameter converted (from a spectral parameter of the source speaker by the voice conversion section 14). This filter has characteristic that a high frequency component is amplified while reducing a low frequency component.

After the voice conversion section 14 converts a spectral parameter $x_t$ of the source speaker, a spectral $Y_t(e_{j\Omega})$ is calculated from the converted spectral parameter $y_t$, and a compensated spectral $Y_{tc}(e_{j\Omega})$ is calculated by applying the compensation filter $H(e_{j\Omega})$ to the spectral $Y_t(e_{j\Omega})$.

By using this filter, spectral characteristic of the spectral parameter (converted by the voice conversion section 14) can be further similar to a target speaker. Voice conversion using interpolation model (by the voice conversion section 14) has smooth characteristic along temporal direction, but a conversion ability to be near a spectral of the target speaker often falls. By applying the compensation filter after converting the spectral parameter, fall of the conversion ability can be avoided.

Furthermore, at S93, a power of the converted spectral is compensated. A ratio of a power of the compensated spectral to a power of a source spectral (of the source speaker) is calculated, and the power of the compensated spectral is compensated by multiplying the ratio. In case of the source spectral $X_t(e_{j\Omega})$ and the compensated power $Y_{tc}(e_{j\Omega})$, a power ratio is calculated as follows.

$$R_t = \sqrt{\frac{\sum |X_t(e^{j\Omega})|^2}{\sum |Y_t^c(e^{j\Omega})|^2}} \tag{7}$$

By applying this power ratio R, a power of the compensated spectral becomes near a power of the source spectral, and instability of the power of the converted spectral can be avoided. Furthermore, as to a power of the source spectral, by multiplying a ratio of an average power of a source speaker to an average power of a target speaker, a power near the power of the target speaker may be used as the compensated value.

Figure 11:
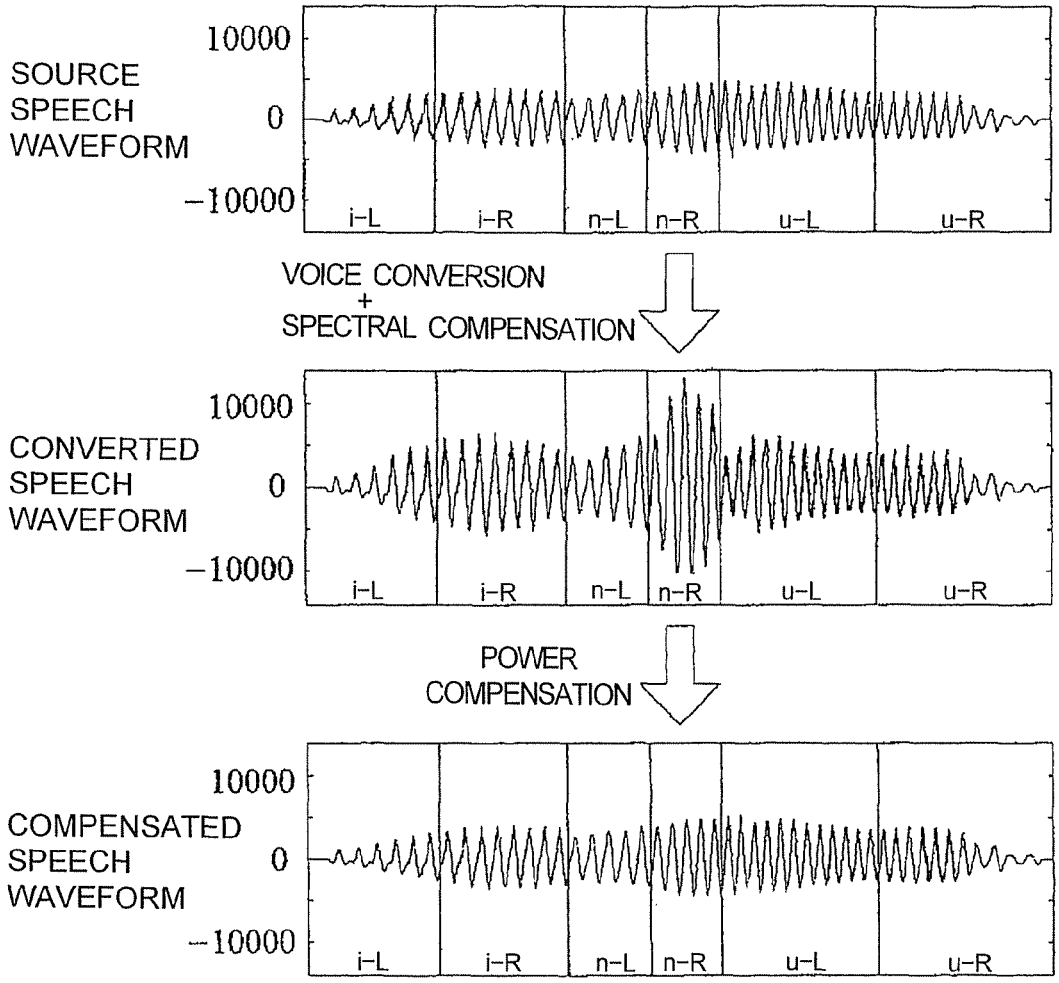
FIG. 11 is a block diagram of another processing example of the spectral compensation section 15.

FIG. 11 shows an example of effect of power compensation for the speech waveform. In FIG. 11, a speech waveform of utterance "i-n-u" is input as a source speech waveform. The source speech waveform (the upper part of FIG. 11) is converted by the voice conversion section 14 and a spectral in a converted speech waveform is compensated. This speech waveform is shown as the middle part in FIG. 11.

Furthermore, a spectral of each pitch waveform is compensated so that a power of the converted speech waveform is equal to a power of the source speech waveform. This speech waveform is shown as the lower part in FIG. 11. In the converted speech waveform (the middle part), unnatural part is included in "n-R" section. However, in the compensated speech waveform (the lower part), the unnatural part is compensated.

(4) The Speech Waveform Generation Section 16

Figure 12:
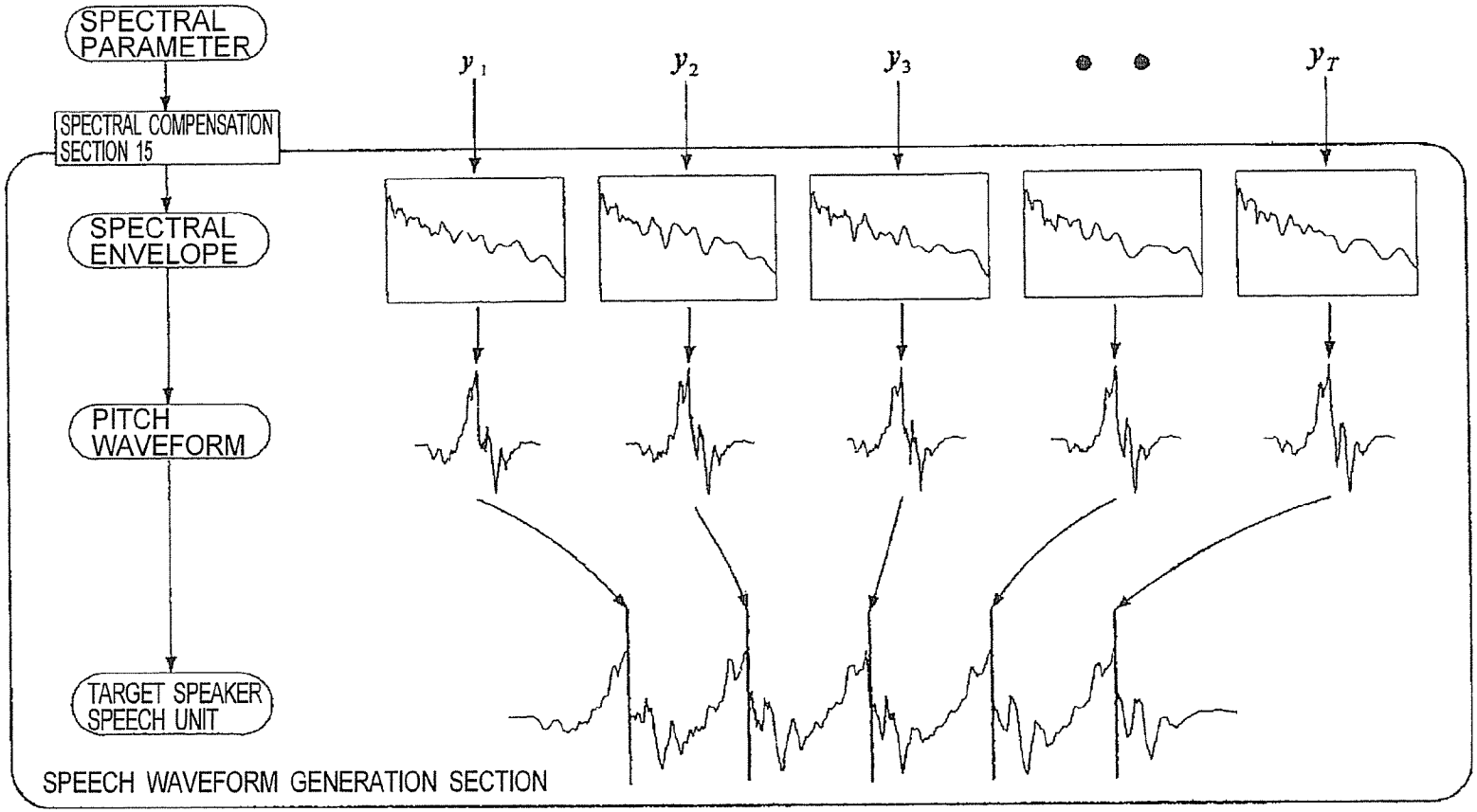
FIG. 12 is a schematic diagram of a processing example of a speech waveform generation section 16 in FIG. 1.

Next, the speech waveform generation section 16 generates a speech waveform from the compensated speech waveform. For example, after assigning a suitable phase to the compensated speech waveform, a pitch waveform is generated by an inverse Fourier transform. Furthermore, by overlap-add synthesizing the pitch waveform to a pitch mark, a waveform is generated. FIG. 12 shows an example of this processing.

First, as to a spectral parameter ($y_1, \ldots, y_T$) of a target speaker (output from the voice conversion section 14), a spectral in the spectral parameter is compensated by the spectral compensation section 15, and a spectral envelope is acquired. A pitch waveform is generated from the spectral envelope, and the pitch waveform is overlap-add synthesized by a pitch mark. As a result, a speech unit of a target speaker is acquired.

In the above case, the pitch waveform is synthesized by the inverse Fourier transform. However, by filtering based on suitable sound source information, a pitch waveform may be re-synthesized. By a total pole filter in case of LPC coefficient, or by MLSA filter in case of mel-cepstrum, a pitch waveform is synthesized from the sound source information and a spectral envelope parameter.

Furthermore, in above-mentioned spectral compensation, filtering is executed for a frequency region. However, after generating a waveform, filtering may be executed for a temporal region. In this case, the voice conversion section generates a converted pitch waveform, and a spectral compensation is applied to the converted pitch waveform.

In this way, by applying voice conversion and spectral compensation to a speech unit of the source speaker (using the voice conversion section 14, the spectral compensation section 15, and the speech waveform generation section 16), a speech unit of a target speaker is acquired. Furthermore, by concatenating each speech unit of the target speaker, speech data of the target speaker corresponding to speech data of the source speaker is generated.

(5) The Voice Conversion Rule Training Section 17

Next, processing of the voice conversion rule training section 17 is explained. In the voice conversion rule training section 17, a voice conversion rule is trained (determined) from a small quantity of speech data of a target speaker and a speech unit database of a source speaker. While training the voice conversion rule, a voice conversion based on interpolation used by the voice conversion section 14 is assumed, and a regression matrix is calculated so that an error of speech unit between the source speaker and the target speaker is minimized.

Figure 13:
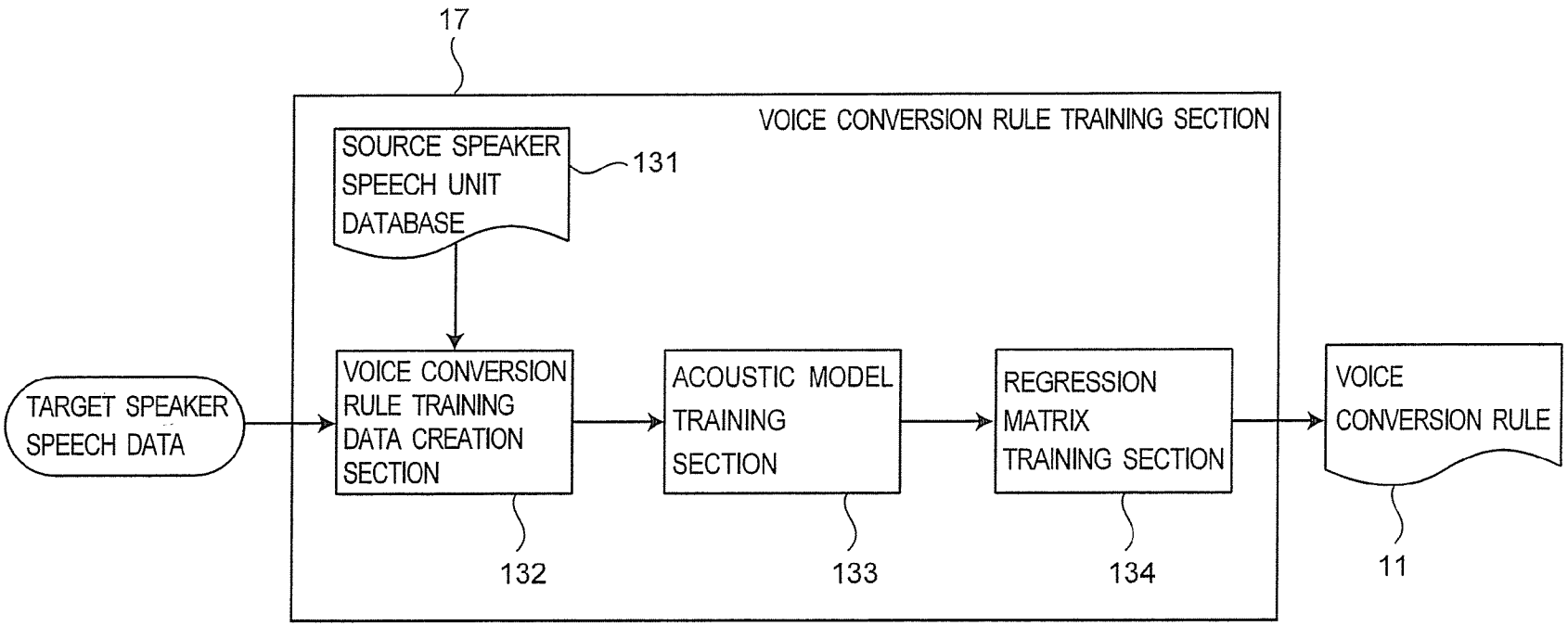
FIG. 13 is a block diagram of a voice conversion rule training section 17 in FIG. 1.

(5-1) Component of the Voice Conversion Rule Training Section 17:

FIG. 13 is a block diagram of the voice conversion rule training section 17. The voice conversion rule training section 17 includes a source speaker speech unit database 131, a voice conversion rule training data creation section 132, an acoustic model training section 133, and a regression matrix training section 134. The voice conversion rule training section 17 trains (determines) the voice conversion rule using a small quantity of speech data of a target speaker.

Figure 14:
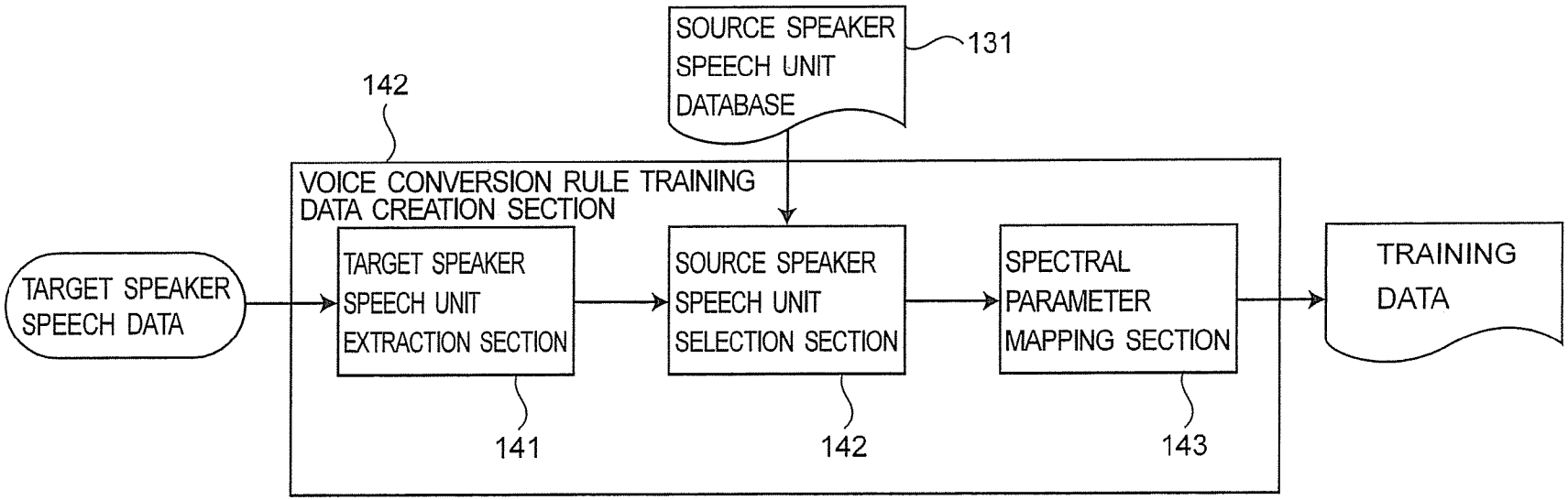
FIG. 14 is a block diagram of a voice conversion rule training data creation section 132 in FIG. 13.

(5-2) The Voice Conversion Rule Training Data Creation Section 132:

FIG. 14 is a block diagram of the voice conversion rule training data creation section 132.

(5-2-1) A Target Speaker Speech Unit Extraction Section 141:

In the target speaker speech unit extraction section 141, speech data of a target speaker (as training data) is segmented into each speech unit (in the same way as processing of the speech unit extraction section 13), and set as a speech unit of the target speaker for training.

(5-2-2) A Source Speaker Speech Unit Selection Section 142:

Next, in the source speaker speech unit selection section 142, a speech unit of a source speaker corresponding to a speech unit of the target speaker is selected from the source speaker speech unit database 131.

As shown in FIGS. 15A and 15B, the source speaker speech unit database 131 stores speech waveform information and attribute information. "Speech waveform information" represents a speech waveform of speech unit in correspondence with a speech unit number. "Attribute information" represents a phoneme, a base frequency, a phoneme duration, a connection boundary cepstrum, and a phone environment in correspondence with a unit number.

In the same way as the non-patent reference 2, the speech unit is selected based on a cost function. The cost function is a function to estimate a distortion between a speech unit of a target speaker and a speech unit of a source speaker by a distortion of attribute. The cost function is represented as linear connection of sub-cost function which represents distortion of each attribute. The attribute includes a logarithm basic frequency, a phoneme duration, a phoneme environment, and a connection boundary cepstrum (spectral parameter of edge point) The cost function is defined as weighted sum of each attribute as follows.

$$C(u_t, u_c) = \sum_{n=1}^{N} WnCn(u_t, u_c) \tag{8}$$

In equation (8), "$C_n(U_t,U_c)$" is a sub-cost function (n:1, . . . , N, (N: number of sub-cost functions)) of each attribute). A basic frequency cost "$C_1(u_t,u_c)$" represents a difference of frequency between a target speaker's speech unit and a source speaker's speech unit. A phoneme duration cost "$C_2(u_t,u_c)$" represents a difference of phoneme duration between the target speaker's speech unit and the source speaker's speech unit. Spectral costs "$C_3(u_t,u_c)$" and "$C_4(u_t,u_c)$" represent a difference of spectral of unit boundary between the target speaker's speech unit and the source speaker's speech unit. Phoneme environment costs "$C_5(u_t,u_c)$" and "$C_6(u_t,u_c)$" represent a difference of phoneme environment between the target speaker's speech unit and the source speaker's speech unit. "$W_n$" represents weight of each sub-cost, "$u_t$" represents the target speaker's speech unit, and "$u_c$" represents the same speech unit as "$u_t$" in the source speaker's speech units stored in the source speaker speech unit database 131.

In the source speaker speech unit selection section 142, as to each speech data of the target speaker, a speech unit having the minimum cost is selected in speech unit having the same phoneme (as the speech data) stored in the source speaker speech unit database 131.

(5-2-3) A Spectral Parameter Mapping Section 143:

A number of pitch waveforms of a selected speech unit of the source speaker is different from a number of pitch waveforms of the speech unit of the target speaker. Accordingly, the spectral parameter mapping section 143 makes each number of pitch waveforms uniform. First, by a DTW method, a linear mapping method, or a mapping method by section linear function, a spectral parameter of the source speaker is corresponded with a spectral parameter of the target speaker. As a result, each spectral parameter of the target speaker maps to a spectral parameter of the source speaker. By this processing, a pair of spectral parameters of the source speaker and the target speaker (one to one correspondence) is acquired and set as training data of the voice conversion rule.

(5-3) The Acoustic Model Training Section 133:

Next, in the acoustic model training section 133, a probability distribution $p_k(x)$ to be stored in the voice conversion rule memory 11 is generated. By using a speech unit of a source speaker as training data, "$p_k(x)$" is calculated by maximum likelihood.

Figure 16:
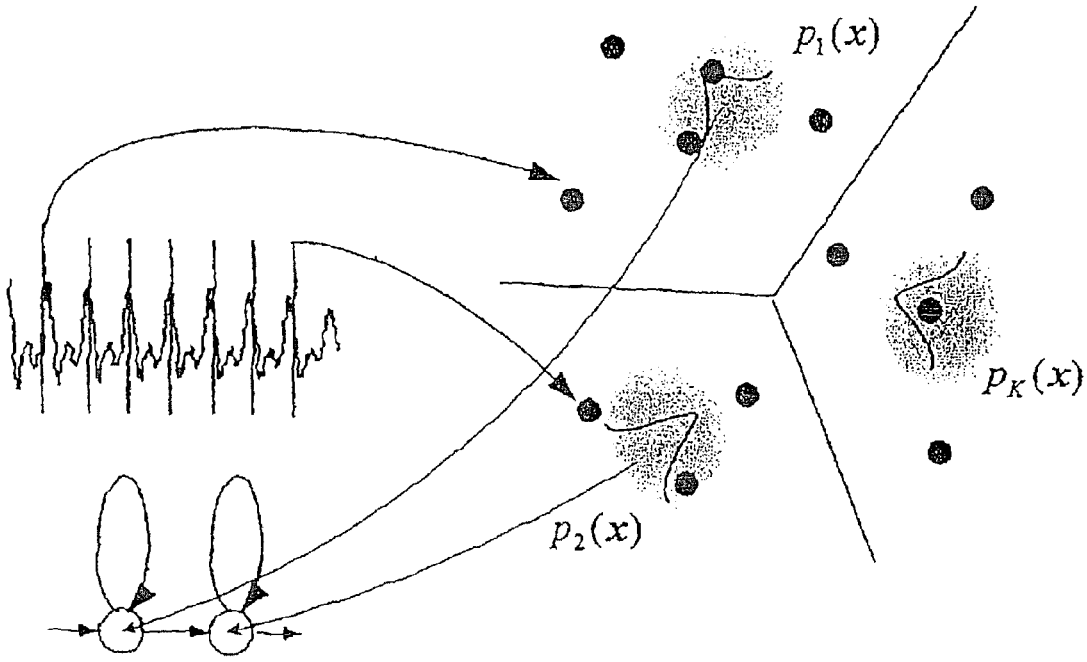
FIG. 16 is a schematic diagram of a processing example of an acoustic model training section 133 in FIG. 13.
Figure 17:
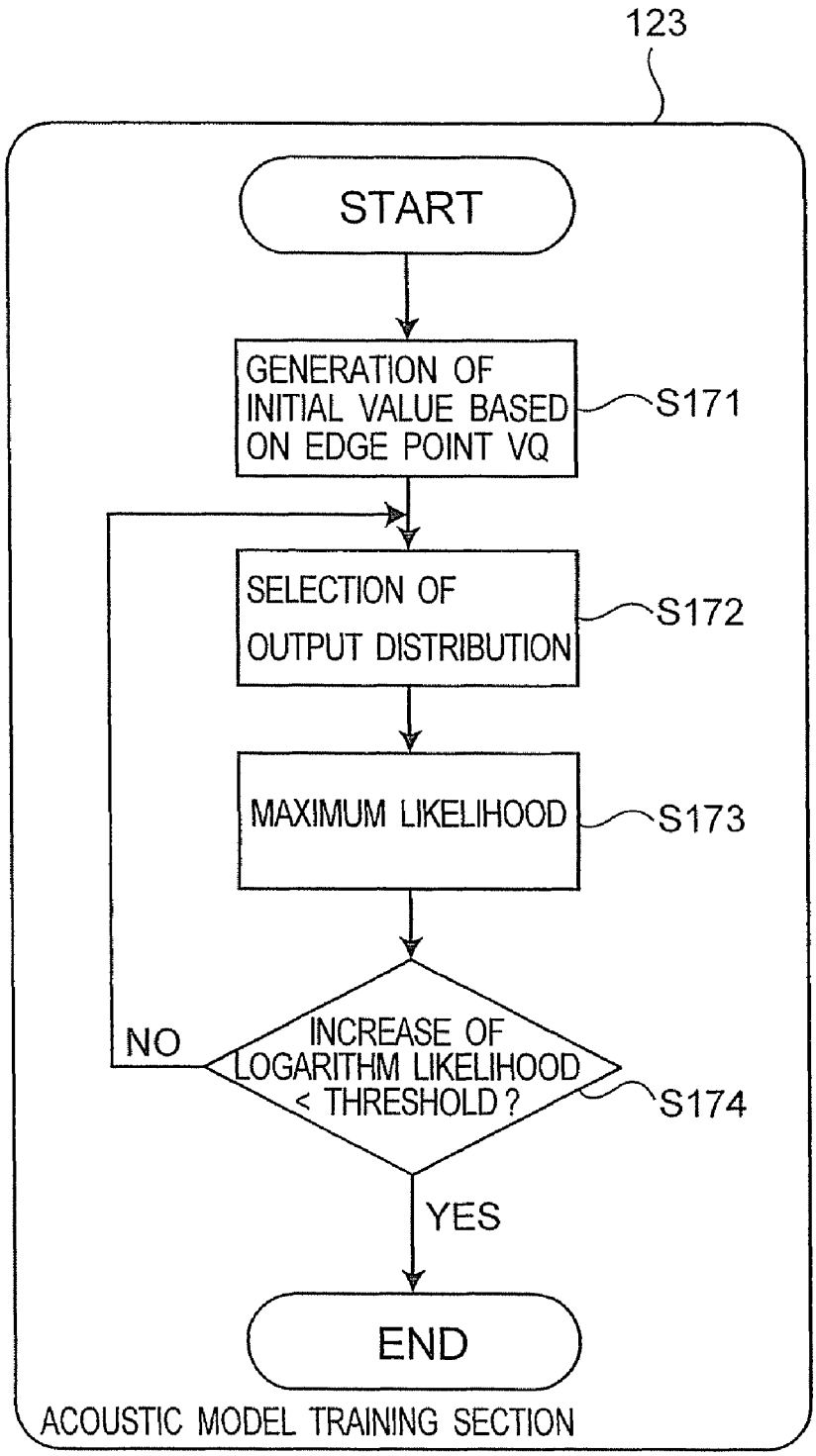
FIG. 17 is a flow chart of processing of the acoustic model training section 133.

FIG. 16 is a schematic diagram of a processing example of the acoustic model training section 133. FIG. 17 is a flow chart of processing of the acoustic model training section 133. The processing includes generation of an initial value based on edge point VQ (S171), selection of output distribution (S172), calculation of a maximum likelihood (S173), and decision of convergence (S174). At S174, when an increase amount by the maximum likelihood is below a threshold, processing is completed. Hereafter, detail processing is explained by referring to FIG. 16.

First, each speech spectral of both edges (start point, end point) of a speech unit in a speech unit database of source speaker is extracted, and clustered (clustering) by vector-quantization. The clustering is executed by vector-quantization. Then, an average vector and a covariance matrix of each cluster are calculated. This distribution as a clustering result is set as an initial value of probability distribution $p_k(x)$.

Next, by assuming an interpolation model of HMM, a maximum likelihood of probability distribution is calculated. As to each speech unit in the speech unit database of source speaker, a probability distribution having the maximum likelihood for speech parameter of both edges (start point, end point) is selected.

Such selected probability distribution is determined as a first state output distribution and a second state output distribution of HMM in the same way as the interpolation coefficient decision section 23. In this way, the output distribution is determined. Furthermore, the average vector and the covariance matrix of the output distribution, and a state transition probability are undated by maximum likelihood of HMM based on EM algorithm. In order to simplify, the state transition probability may be used as a constant value. By repeating update until likelihood values converge, the probability distribution $p_k(x)$ having the maximum likelihood based on interpolation model of HMM is acquired.

At step of update, the output distribution may be re-selected. In this case, at each step of update, a distribution of each state is re-selected so that likelihood of HMM increases, and update is repeated. In case of selecting the distribution having the maximum likelihood, calculation of likelihood of HMM is necessary as $K_2$ times (K: the number of distribution), and this calculation method is not actual. By selecting an output distribution having the maximum likelihood for spectral parameter of edge points, only if a likelihood of HMM for the speech unit increases, a previous output distribution (used for previous repeat) may be replaced with the selected output distribution.

(5-4) The Regression Matrix Training Section 134:

In the regression matrix training section 134, a regression matrix is trained based on a probability distribution from the acoustic model training section 133. The regression matrix is calculated by multiple regression analysis. In case of interpolation model, an estimation equation of a regression matrix to calculate a target spectral parameter y from a source spectral parameter x is calculated by equations (1) and (6) as follows.

$$y=(\omega_s W_s x+\omega_e W_e)x=(W_s|W_e)(\omega_s,\ \omega_s x^T,\ \omega_e,\ \omega_e X^T)^T \tag{9}$$

In above equation (9), "$W_s$" and "$W_e$" are respectively the regression matrix of a start point and an end point. "$\omega_s$" and "$\omega_e$" are interpolation coefficients. The interpolation coefficient is calculated in the same way as the interpolation coefficient decision section 23. In this case, an estimation equation of the regression matrix for parameter y(p) of p-degree is searched as W having the minimum square error in following equation.

$$E^{(p)}=(Y^{(p)}-XW^{(p)})'(Y^{(p)}-XW^{(p)}) \tag{10}$$

In equation (10), "$Y^{(p)}$" is a vector that p-degree parameters of target spectral parameter are sorted, and represented as follows.

$$y^{(p)}=(Y_1^{(p)},\ Y_2^{(p)},\ \ldots,\ Y_M^{(p)}) \tag{11}$$

In equation (11), "M" is the number of spectral parameters of training data. "X" is a vector that source spectral parameters each multiplied with weight are sorted. As to m-th training data, in case that "$k_s$" is a regression matrix number of start point and "$k_e$" is a regression matrix number of end point, "$X_m$" is a vector that ($k_s$×P)-th and ($k_e$×P)-th (P: the number of degree of vector) respectively has a value except for "0" as follows.

$$Xm=\left(0,\ \ldots,\ 0,\ \underbrace{\omega_s(1,\ x^T)^T}_{ks-th},0,\ \ldots,\ 0,\ \underbrace{\omega_e(1,\ x^T)^T}_{ke-th},0,\ \ldots,\ 0\right) \tag{12}$$

Equation (12) may be represented as a matrix as follows.

$$X=(X_1,X_2,\ \ldots,X_M)^T \tag{13}$$

In equation (13), a regression coefficient $W^{(p)}$ for p-degree coefficient is determined by solving the following equation.

$$(X^T X)W^{(p)}=X^T Y \tag{14}$$

In equation (14), "$W^{(p)}$" is represented as follows.

$$W^{(p)}=(w_1^{(p)T},w_2^{(p)T},\ \ldots,w_K^{(p)T})^T \tag{15}$$

In equation (15), "$W_k^{(p)}$" is a value of p-th line of k-th regression matrix stored in the voice conversion rule memory 11 as shown in FIG. 6. Equation (12) solves for all degrees, and elements of k-th regression matrix are sorted as follows.

$$W_k=(w_k^{(1)T},\ w_k^{(2)T},\ \ldots,\ w_K^{(p)T})^T \tag{16}$$

By above processing in the regression matrix training section 134, the probability distribution and the regression matrix in the voice conversion rule memory 11 are created.

(6) The Spectral Compensation Rule Training Section 18

Next, processing of the spectral compensation rule training section is explained. The spectral compensation section 15 compensates a spectral converted by the voice conversion section 14. As the compensation, spectral compensation and power compensation are subjected as mentioned-above.

(6-1) Spectral Compensation:

As to spectral compensation, a converted spectral parameter from the voice conversion section 14 is compensated to be nearer a target speaker. As a result, fall of conversion accuracy caused from the interpolation model assumed in the voice conversion section 14 is compensated.

Figure 18:
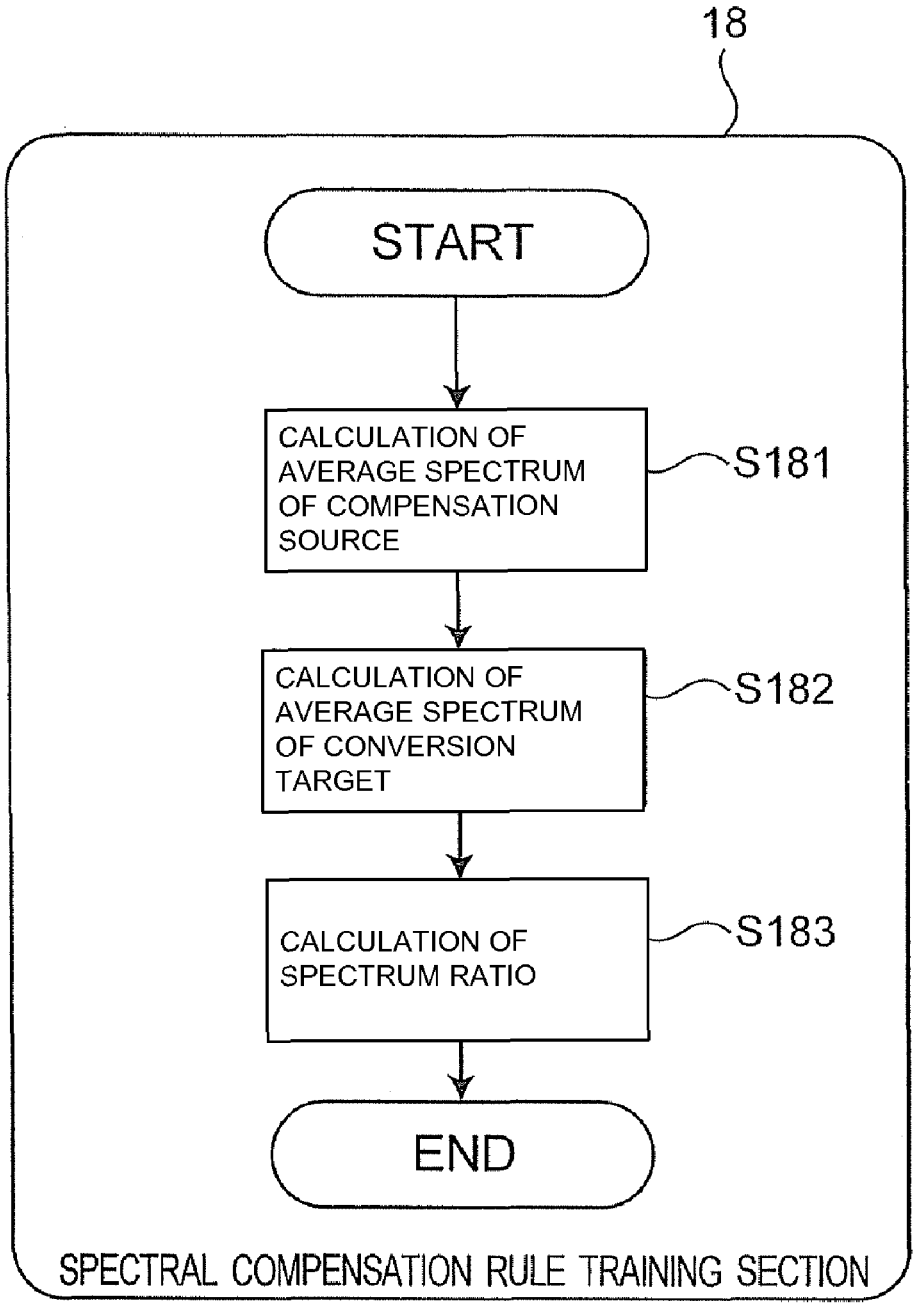
FIG. 18 is a flow chart of processing of a spectral compensation rule training section 18 in FIG. 1.

FIG. 18 is a flow chart of processing of the spectral compensation rule training section 18. The spectral compensation rule is trained using a pair of training data (source spectral parameter, target spectral parameter) acquired by the voice conversion rule training data creation section 132.

First, at S181, an average spectral of compensation source is calculated. A source spectral parameter of a source speaker is converted by the voice conversion section 14, and a target spectral parameter of a target speaker is acquired. A spectral calculated from the target spectral parameter is a spectral of compensation source. The spectral of compensation source is calculated by converting the source spectral parameter of the pair of training data (output from the voice conversion rule training data creation section 132), and an average spectral of compensation source is acquired by averaging the spectral of compensation source of all training data.

Next, at S182, an average spectral of conversion target is calculated. In the same way as the average spectral of compensation source, a conversion target spectral is calculated from spectral parameter of conversion target of a pair of training data (output from the voice conversion rule training data 132), and an average spectral of conversion target is acquired by averaging the spectral of conversion target of all training data.

Next, a ratio of the average spectral of compensation source to the average spectral of conversion target is calculated and set as a spectral compensation rule. In this case, amplitude spectral is used as the spectral.

Assume that an average speech spectral of a target speaker is $Y_{ave}(e^{j\Omega})$ and an average speech spectral of a compensation source is $Y'_{ave}(e^{j\Omega})$. An average spectral ratio $H(e^{j\Omega})$ as a ratio of amplitude spectral is calculated as follows.

$$H(e^{j\Omega}) = \frac{|Y_{ave}(e^{j\Omega})|}{|Y'_{ave}(e^{j\Omega})|} \tag{17}$$

Figure 19:
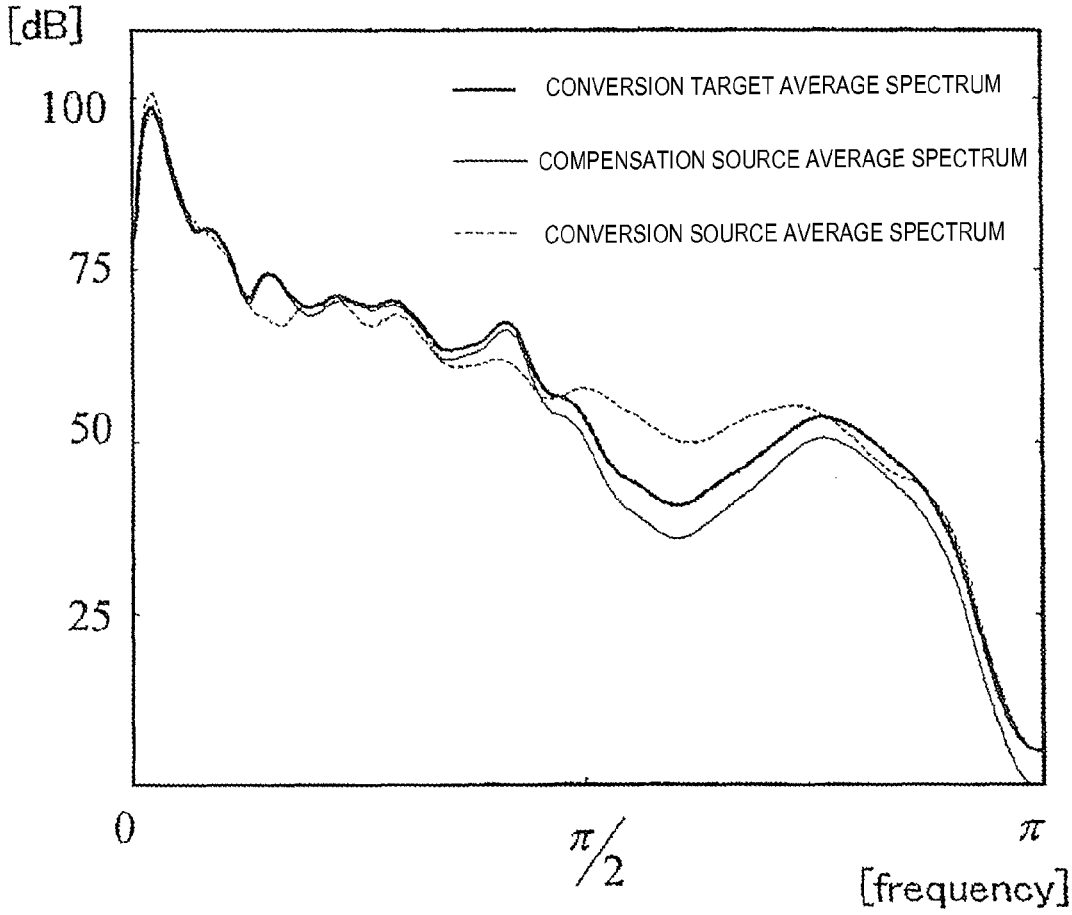
FIG. 19 is a schematic diagram of a processing example of the spectral compensation rule training section 18.
Figures 20, 21:
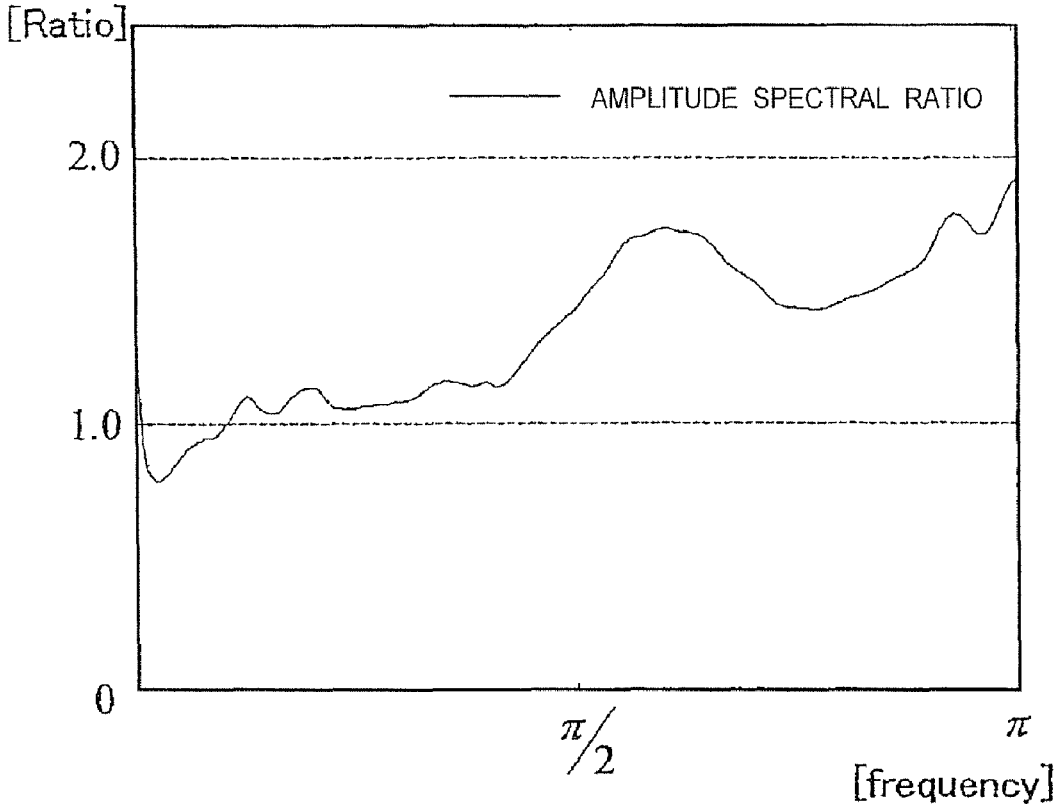
FIG. 20 is a schematic diagram of another processing example of the spectral compensation rule training section 18.
FIG. 21 is a schematic diagram of another example of the voice conversion rule memory 11.

(6-2) Spectral Compensation Rule:

FIGS. 19 and 20 show example spectral compensation rules. In FIG. 19, a thick line represents an average spectral of conversion target, a thin line represents an average spectral of compensation source, and a dotted line represents an average spectral of conversion source.

The average spectral is converted from the conversion source to the compensation source by the voice conversion section 14. In this case, the average spectral of compensation source becomes near the average spectral of conversion target. However, they are not equally matched, and approximate error occurs. This shift is represented as a ratio as shown in amplitude spectral ratio of FIG. 20. By applying the amplitude spectral ratio to each spectral (output from the voice conversion section 14), a spectral shape of each spectral is compensated.

The spectral compensation rule memory 12 stores a compensation filter of the average spectral ratio. As shown in FIG. 10, the spectral compensation section 15 applies this compensation filter.

Furthermore, the spectral compensation rule memory 12 may store an average power ratio. In this case, an average power of target speaker and an average power of compensation source are calculated, and the ratio is stored. A power ratio $R_{ave}$ is calculated from the average spectral $Y_{ave}(e^{j\Omega})$ of conversion target and the average spectral $X_{ave}(e^{j\Omega})$ of conversion source as follows.

$$R_{ave} = \sqrt{\frac{\sum |Y_{ave}(e^{j\Omega})|^2}{\sum |X_{ave}(e^{j\Omega})|^2}} \tag{18}$$

In the spectral compensation section 15, as to a spectral calculated from a spectral parameter (output from the voice conversion section 14), power compensation to a conversion source spectral is subjected. Furthermore, by multiplying an average power ratio $R_{ave}$, the average power can be nearer the target speaker.

(7) Effect

As mentioned-above, in the first embodiment, by compensating a regression matrix with probability, a voice can be smoothly converted along temporal direction. Furthermore, by compensating a spectral or a power of converted speech parameter, fall of similarity (caused by interpolation model assumed) to the target speaker can be reduced.

(8) Modification Examples

In the first embodiment, an interpolation model with probability is assumed. However, in order to simplify, linear interpolation may be used. In this case, as shown in FIG. 21, the voice conversion rule memory 11 stores a regression matrix of K units and a typical spectral parameter corresponding to each regression matrix. The voice conversion section 14 selects the regression matrix using the typical spectral parameter.

Figure 22:
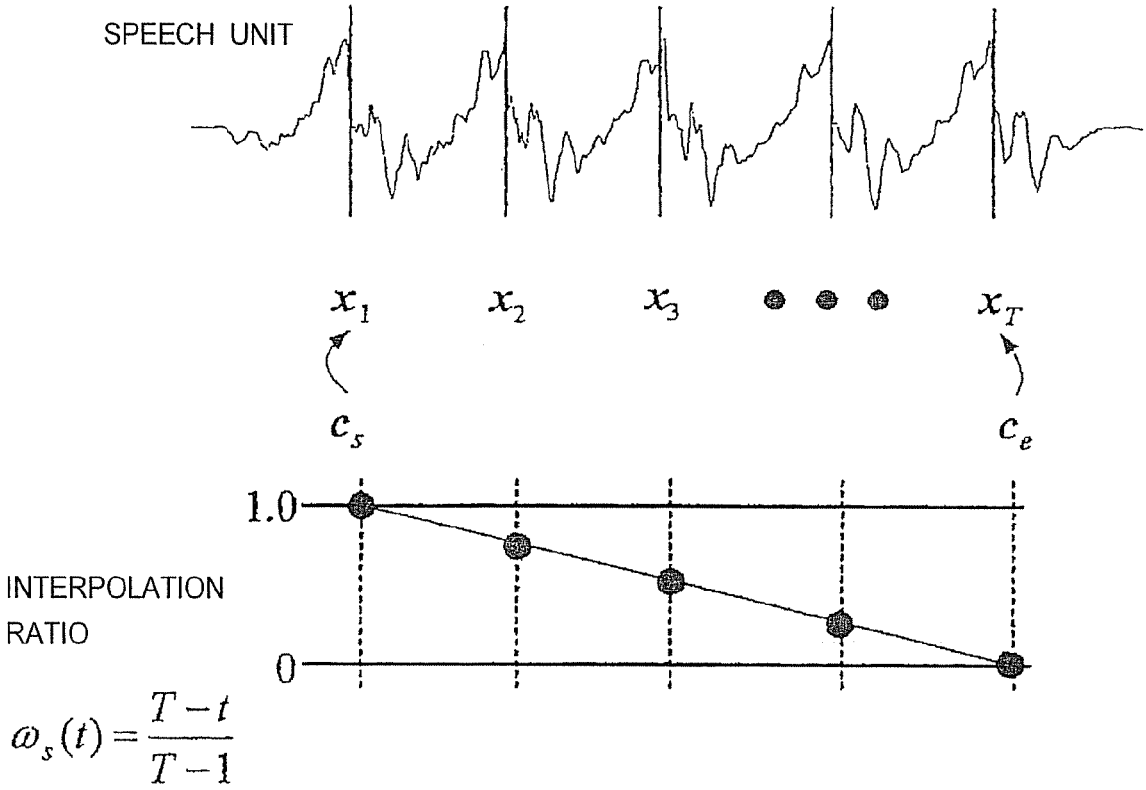
FIG. 22 is a schematic diagram of another processing example of the voice conversion section 14.

As shown in FIG. 22, as to a spectral parameter $x_t$ ($1=<t=<T$) of T units, a regression matrix $w_k$ corresponding to $c_k$ having the minimum distance from a start point $x_1$ is selected as a regression matrix $W_s$ of the start point $x_1$. In the same way, a regression matrix $w_k$ corresponding to $c_k$ having the minimum distance from an end point $x_T$ is selected as a regression matrix $W_e$ of the end point $x_T$.

Next, the interpolation coefficient decision section 23 determines an interpolation coefficient based on linear interpolation. In this case, an interpolation coefficient $\omega_s(t)$ corresponding to a regression matrix of a start point is represented as follows.

$$\omega_s(t) = \frac{T-t}{T-1} \tag{19}$$

In the same way, $\omega_e(t)$ corresponding to a regression matrix of an end point is represented as follows.

$$\omega_e(t)=1-\omega_s(t)$$

By using these interpolation coefficients and the equation (6), a regression matrix W(t) of timing t is calculated.

In case of linear interpolation, the acoustic model training section 133 (in the voice conversion rule training section 17) creates a typical spectral parameter $c_k$ to be stored in the voice conversion rule memory 11. "$c_k$" is used as an average vector of initial value of edge point VQ (Vector Quantization).

Briefly, speech spectral of both edges of speech units (stored in the speech unit database of source speaker) is selected and clustered (clustering) by vector-quantization. The clustering can be executed by LBG algorithm. Then, a centroid of each cluster is stored as $c_k$.

Furthermore, in the regression matrix training section 134 (in the voice conversion rule training section 17), a regression matrix is trained using a typical spectral parameter acquired from the acoustic model training section 133. The regression matrix is calculated in the same way as equations (9)~(16). As for $\omega_s$ and $\omega_e$ in the equations (9)~(16), the regression matrix is trained using the equation (19) instead of the equations (3) and (4). In case of determining interpolation weight, change degree of each pitch waveform of speech unit of source speaker is not taken into consideration. However, processing quantity during voice converting and voice conversion rule training can be reduced.

The Second Embodiment

A text speech synthesis apparatus according to the second embodiment is explained by referring to FIGS. 23-28. This text speech synthesis apparatus is a speech synthesis apparatus having the voice conversion apparatus of the first embodiment. As to an arbitrary input sentence, a synthesis speech having a target speaker's voice is generated.

(1) Component of the Text Speech Synthesis Apparatus

Figure 23:
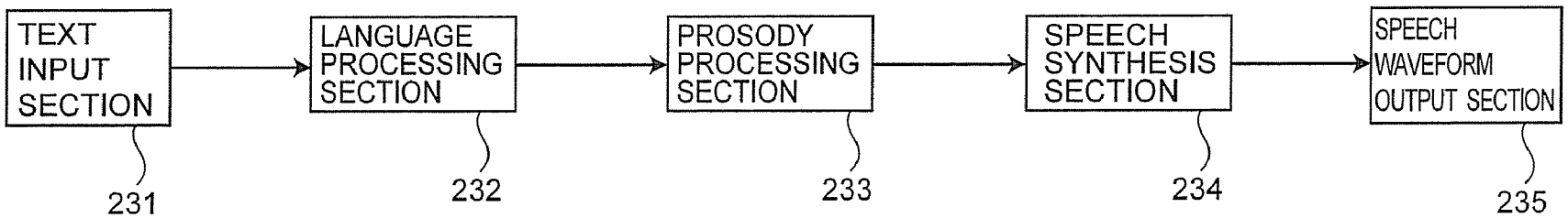
FIG. 23 is a block diagram of a speech synthesis apparatus according to a second embodiment.

FIG. 23 is a block diagram of the text speech synthesis apparatus according to the second embodiment. The text speech synthesis apparatus includes a text input section 231, a language processing section 232, a prosody processing section 233, a speech synthesis section 234, and a speech waveform output section 235.

The language processing section 232 executes morphological analysis and syntactic analysis to an input text from the text input section 231, and outputs the analysis result to the prosody processing section 233. The prosody processing section 233 processes accent and intonation from the analysis result, generates a phoneme sequence (phoneme sign sequence) and prosody information, and sends them to the speech synthesis section 234. The speech synthesis section 234 generates a speech waveform from the phoneme sequence and the prosody information. The speech waveform output section 235 outputs the speech waveform.

(2) Speech Synthesis Section 234

Figure 24:
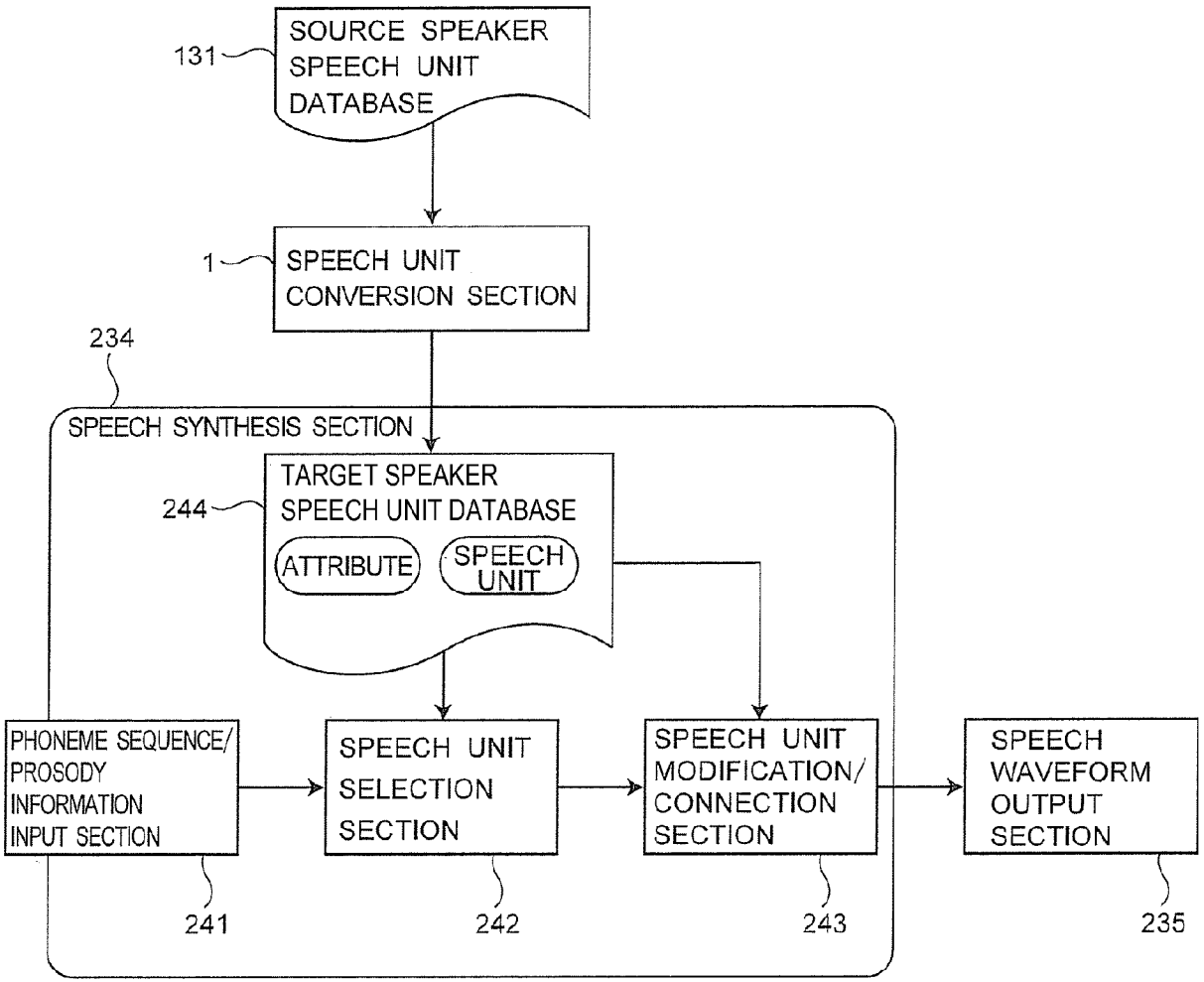
FIG. 24 is a schematic diagram of a speech synthesis section 234 in FIG. 23.

FIG. 24 is a block diagram of the speech synthesis section 234. The speech synthesis section 234 includes a phoneme sequence/prosody information input section 241, a speech unit selection section 242, a speech unit modification/connection section 243, and a target speaker speech unit database storing speech unit and attribute information of a target speaker.

In the second embodiment, as to each speech unit in the source speaker speech unit database 131, the target speaker speech unit database 244 stores each speech unit (of a target speaker) converted by the speech unit conversion section 1 of the voice conversion apparatus of the first embodiment.

(2-1) The Source Speaker Speech Unit Database 131:

In the same way as the first embodiment, the source speaker speech unit database stores each speech unit (segmented from speech data of source speaker) and attribute information.

As shown in FIG. 15A, as to the speech unit, a waveform (having a pitch mark) of a speech unit of a source speaker is stored with a unit number to identify the speech unit. As shown in FIG. 15B, as to the attribute information, information used by the speech unit selection section 242, such as a phoneme (half-phoneme), a basic frequency, a phoneme duration, a connection boundary cepstrum, and a phoneme environment are stored with the unit number. In the same way as speech unit extraction and attribute generation of the target speaker, the speech unit and the attribute information are created from speech data of the source speaker by steps such as labeling, pitch-marking, attribute generation, and unit extraction.

(2-2) The Speech Unit Conversion Section 1:

Using the speech units stored in the source speaker speech unit database 131, the speech unit conversion section 1 generates the target speaker speech unit database 244 which stores each speech unit (of a target speaker) converted by the voice conversion section 1 of the first embodiment.

As to each speech unit of the source speaker, the speech unit conversion section 1 executes voice conversion processing in FIG. 1. Briefly, the voice conversion section 14 converts a voice of speech unit, the spectral compensation section 15 compensates a spectral of converted speech unit, and the speech waveform generation section 16 overlap-add synthesizes a speech unit of the target speaker by generating pitch waveform. In the voice conversion section 14, a voice is converted by the speech parameter extraction section 21, the conversion rule selection section 22, the interpolation rule coefficient decision section 23, the conversion rule generation section 24, and the speech parameter conversion section 25. In the spectral compensation section 15, a spectral is compensated by processing in FIG. 9. In the speech waveform generation section 16, a converted speech waveform is acquired by processing in FIG. 12. In this way, a speech unit of the target speaker and the attribute information are stored in the target speaker speech unit database 244.

(2-3) Detail of the Speech Synthesis Section 234:

The speech synthesis section 234 selects speech units from the target speaker speech unit database 244, and executes speech synthesis.

(2-3-1) The Phoneme Sequence/Prosody Information Input Section 241:

The phoneme sequence/prosody information input section 241 inputs a phoneme sequence and prosody information corresponding to input text (output from the prosody processing section 233). As the prosody information, a basic frequency and a phoneme duration are input.

(2-3-2) The Speech Unit Selection Section 242:

As to each speech unit of input phoneme sequence, the speech unit selection section 242 estimates a distortion degree of synthesis speech based on input prosody information and attribute information (stored in the speech unit database 244), and selects a speech unit from speech units stored in the speech unit database 244 based on the distortion degree.

The distortion degree is calculated as a weighted sum of a target cost and a connection cost. The target cost is based on a distortion between attribute information (stored in the speech unit database 244) and a target phoneme environment (sent from the phoneme sequence/prosody information input section 241). The connection cost is based on a distortion of phoneme environment between two connected speech units.

A sub-cost function $C_n(u_i,u_{i-1},t_i)$ (n:1, . . . , N, N: number of sub-cost function) is determined for each element of distortion caused when a synthesis speech is generated by modifying/connecting speech units. The cost function of the equation (8) in the first embodiment may calculate a distortion between two speech units. On the other hand, a cost function in the second embodiment may calculate a distortion between input prosody/phoneme sequence and speech units, which is different from the first embodiment. "$t_1$" represents attribute information as a target of speech unit corresponding to i-th segment in case that a target speech corresponding to input phoneme sequence/prosody information is $t=(t_1, \ldots, t_I)$. "$u_i$"

represents a speech unit having the same phoneme as $t_i$ in speech units stored in the target speaker speech unit database 244.

The sub-cost function is used for calculating a cost to estimate a distortion degree between a target speech and a synthesis speech in case of generating the synthesis speech from speech units stored in the target speaker speech unit database 244. Target costs may include a basic frequency cost $C_1(u_i,u_{i-1},t_i)$ representing a difference between a target basic frequency and a basic frequency of a speech unit stored in the target speaker speech unit database 244, a phoneme duration cost $C_2(u_i,u_{i-1},t_i)$ representing a difference between a target phoneme duration and a phoneme duration of the speech unit, and a phoneme environment cost $C_3(u_i,u_{i-1},t_i)$ representing a difference between a target environment cost and an environment cost of the speech unit. A connection cost may include a spectral connection cost $C_4(u_i,u_{i-1},t_i)$ representing a difference of spectral between two adjacent speech units at a connection boundary.

A weighted sum of these sub-cost functions is defined as a speech unit as follows.

$$C(ui, ui-1, ti) = \sum_{n=1}^{N} w_n C_n(u_i, u_{i-1}, t_i) \tag{20}$$

In equation (20), "$w_n$" represents weight of the sub-cost function. In the second embodiment, in order to simplify, "$w_n$" is "1". The equation (20) represents a speech unit cost of some speech unit applied.

As to each segment (speech unit) divided from an input phoneme sequence, a speech unit cost calculated from the equation (20) is added for all segments, and the sum is called a cost. A cost function to calculate the cost is defined as follows.

$$\text{Cost} = \sum_{i=1}^{I} C(u_1, u_{i-1}, t_i) \tag{21}$$

The speech unit selection section 242 selects a speech unit using a cost function of the equation (21). From speech units stored in the target speaker speech unit database 244, a combination of speech units having the minimum value of the cost function is selected. The combination of speech units is called the most suitable unit sequence. Briefly, each speech unit of the most suitable unit sequence corresponds to each segment (synthesis unit) divided from the input phoneme sequence. The speech unit cost calculated from each speech unit of the most suitable speech unit sequence and the cost calculated from the equation (21) are smaller than any other speech unit sequence. The most suitable unit sequence can be effectively searched using DP (Dynamic Programming method).

(2-3-3) The Speech Unit Modification/Connection Section 243:

The speech unit modification/connection section 243 generates, by modifying the selected speech units according to input phoneme information and connecting the modified speech units, a speech waveform of synthesis speech. Pitch waveforms are extracted from the selected speech unit, and the pitch waveforms are overlapped-added so that a basic frequency and a phoneme duration of the speech unit are respectively equal to a target basic frequency and a target phoneme duration of the input prosody information. In this way, a speech waveform is generated.

Figure 25:
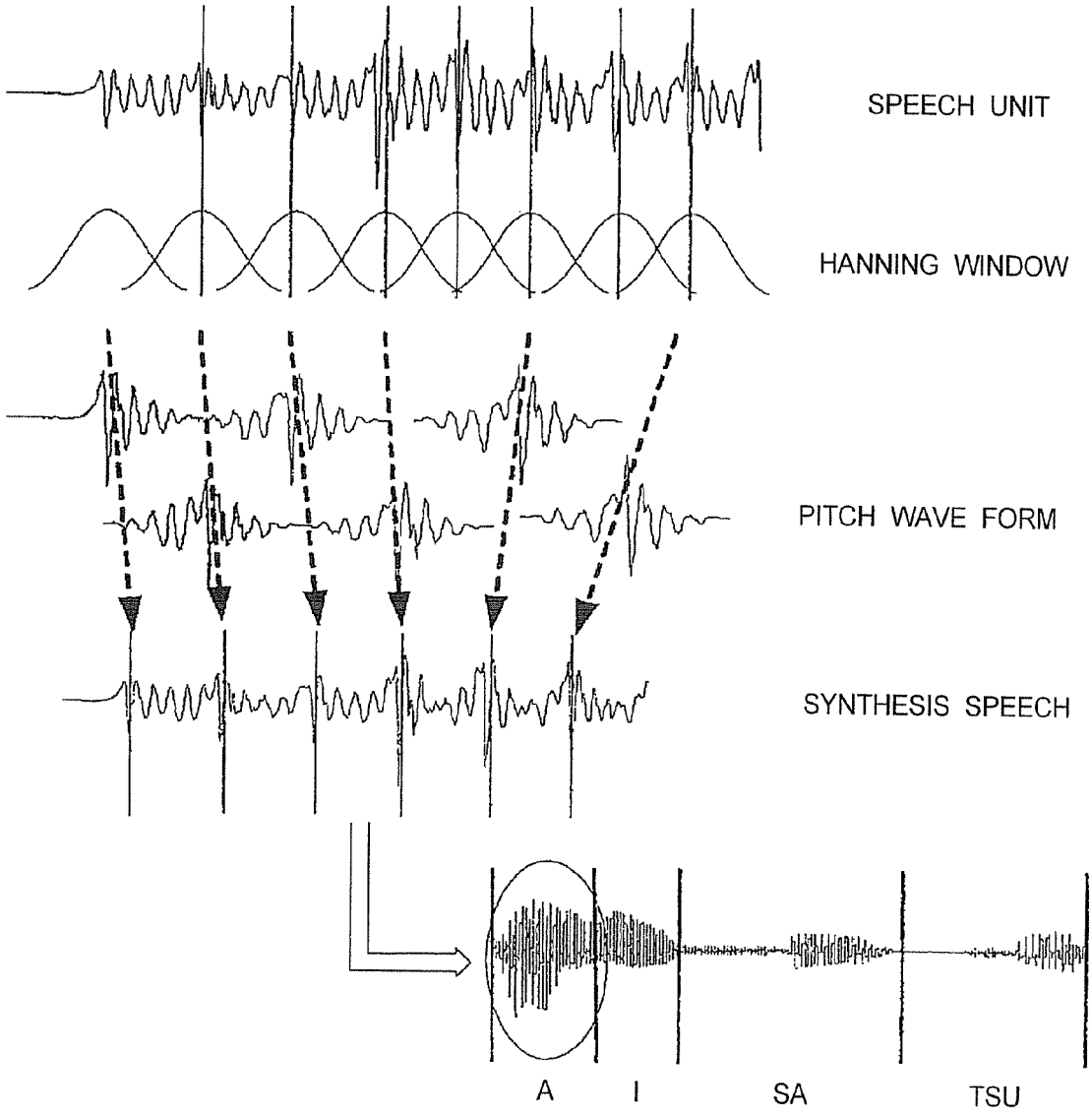
FIG. 25 is a schematic diagram of a processing example of a speech unit modification/connection section 234 in FIG. 23.

FIG. 25 is a schematic diagram of processing of the speech unit modification/connection section 243. In FIG. 25, an example to generate a speech unit of a phoneme "a" in a synthesis speech "AISATSU" is shown. From the upper side of FIG. 25, a speech unit, a Hanning window, a pitch waveform and a synthesis speech, are shown. A vertical bar of the synthesis speech represents a pitch mark which is created based on a target basic frequency and a target duration in the input prosody information.

By overlap-add synthesizing pitch waveforms (extracted from the selected speech unit) of a predetermined speech unit based on the pitch mark, a basic frequency and a phoneme duration are changed with unit-modification. Then, synthesis speech is generated by connecting pitch waveforms between two adjacent speech units.

(3) Effect

As mentioned-above, in the second embodiment, by using the target speaker speech unit database 244 having speech unit converted by the speech unit conversion section 1 in the first embodiment, speech unit of unit selection type can be executed. As a result, synthesized speech corresponding to an arbitrary input sentence is generated.

Concretely, by applying a voice conversion rule (generated using small quantity of speech data of a target speaker) to each speech unit of the source speaker speech unit database 131, the target speaker speech unit database 244 is generated. By synthesizing a speech from the target speaker speech unit database 244, synthesized speech of arbitrary sentence having the target speaker's voice is acquired.

Furthermore, in the second embodiment, a voice can be smoothly converted along temporal direction based on interpolation of the conversion rule, and the voice can be naturally converted by spectral compensation. Briefly, speech is synthesized from the target speaker speech unit database after voice conversion of the source speaker speech unit database. As a result, a natural synthesized speech of the target speaker is acquired.

(4) Modification Example 1

In the second embodiment, a voice conversion rule is previously applied to each speech unit stored in the source speaker speech unit database 131. However, the voice conversion rule may be applied in case of synthesizing.

Figure 26:
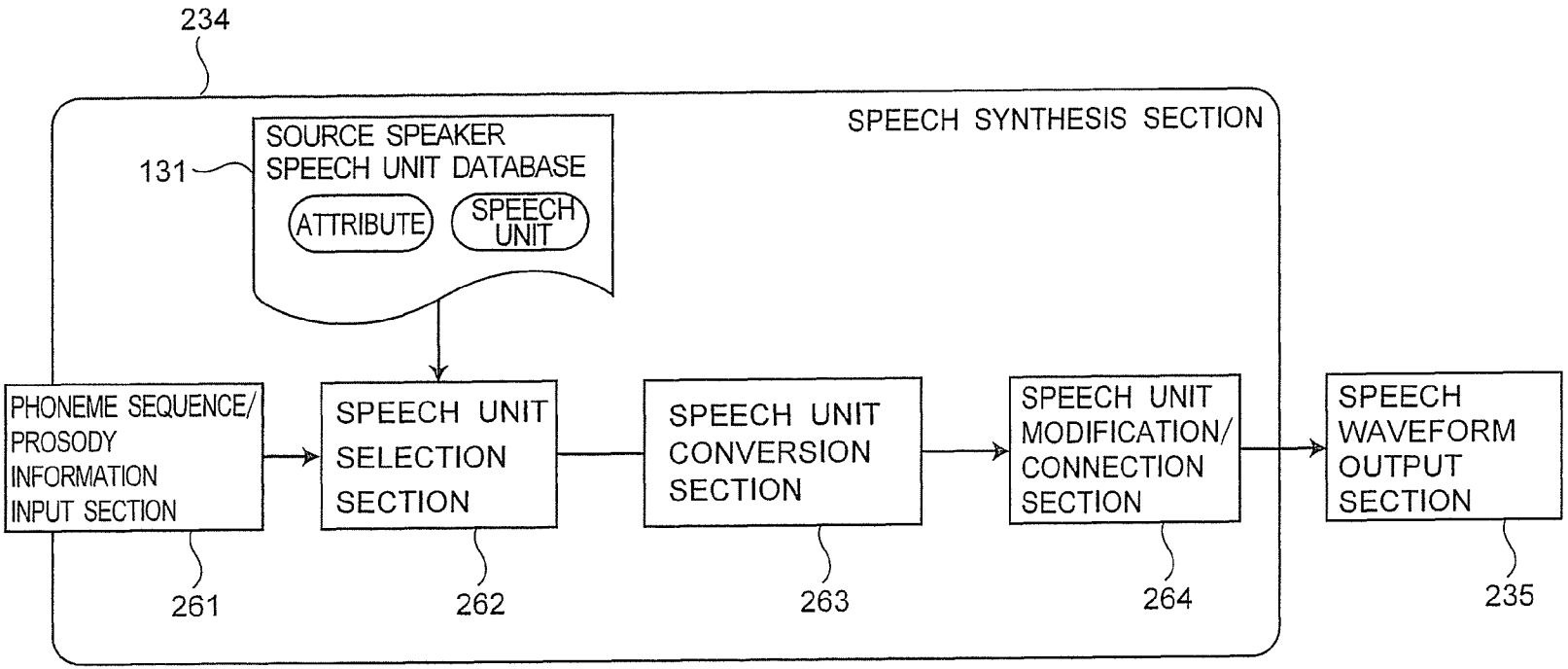
FIG. 26 is a schematic diagram of a first modification example of the speech synthesis section 234.

(4-1) Component:

As shown in FIG. 26, the speech synthesis section 234 holds the source speaker speech unit database 131. In case of synthesizing, a phoneme sequence/prosody information input section 261 inputs a phoneme sequence and prosody information as a text analysis result. A speech unit selection section 262 selects speech units based on a cost calculated from the source speaker speech unit database 131 by equation (21). A speech unit conversion section 263 converts the selected speech unit. Voice conversion by the speech unit conversion section 263 is executed as processing of the speech unit conversion section 1 of FIG. 1. Then, a speech unit modification/connection section 264 modifies prosody of the selected speech units and connects the modified speech units. In this way, synthesized speech is acquired.

(4-2) Effect:

In this component, calculation quantity of speech synthesis increases because voice conversion processing is necessary for speech synthesis. However, the voice unit conversion section 263 converts a voice of a speech unit to be synthesized. In case of generating a synthesis speech by a target speaker's voice, the target speaker speech unit database is not necessary.

Accordingly, in case of composing a speech synthesis system that synthesizes a speech by various speaker's voice, the source speaker speech unit database, a voice conversion rule, and a spectral compensation rule are only necessary. As a result, speech synthesis can be realized by memory quantity smaller than a speech unit database of all speakers.

Furthermore, in case of generating a conversion rule for a new speaker, only this conversion rule can be transmitted to another speech synthesis system via a network. Accordingly, in case of transmitting the new speaker's voice, the speech unit database of the new speaker need not be transmitted, and information quantity necessary for transmission can be reduced.

(5) Modification Example 2

In the second embodiment, voice conversion is applied to speech synthesis of unit selection type. However, voice conversion may be applied to speech unit of plural unit selection/fusion type.

Figure 27:
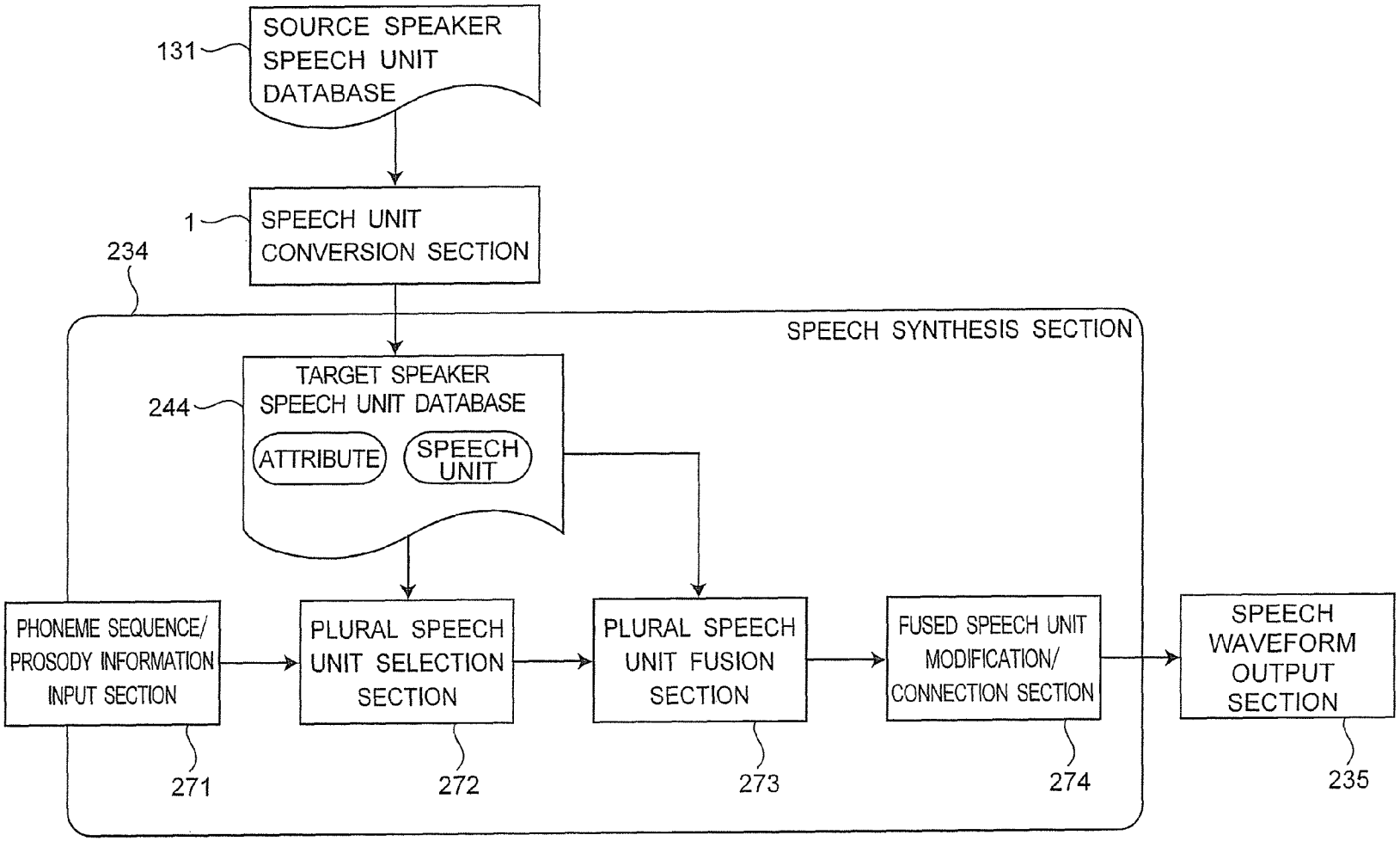
FIG. 27 is a schematic diagram of a second modification example of the speech synthesis section 234.

FIG. 27 is a block diagram of the speech synthesis apparatus of the plural unit selection/fusion type. The speech unit conversion section 1 converts the source speaker speech unit database 131, and generates the target speaker speech unit database 244.

In the speech synthesis section 234, a phoneme sequence/prosody information input section 271 inputs a phoneme sequence and prosody information as a text analysis result. A plural speech unit selection section 272 selects a plurality of speech units based on a cost calculated from the source speaker speech unit database 244 by equation (21). A plural speech unit fusion section 273 generates a fused speech unit by fusing the plurality of speech units. Then, a fused speech unit modification/connection section 274 modifies prosody of the fused speech unit and connects the modified speech units. In this way, synthesized speech is acquired.

Processing of the plural speech unit selection section 272 and the plural speech unit fusion section 273 is disclosed in JP-A No. 2005-164749. The plural speech unit selection section 272 selects the most suitable speech unit sequence by DP algorithm so that a value of the cost function of the equation (21) is minimized. Then, in a segment corresponding to each speech unit, a sum of a connection cost with the most suitable speech unit of two adjacent segments (before and after the segment) and a target cost that with input attribute of the segment is set as a cost function. From speech units having the same phoneme in the target speaker speech unit database, speech units are selected in order of smaller value of the cost function.

The selected speech units are fused by the plural speech unit fusion section 273, and a speech unit representing the selected speech units is acquired. In case of fusing the speech units, a pitch waveform is extracted from each speech unit, a number of waveforms of the pitch waveform is equalized to pitch mark generated from a target prosody by copying or deleting the pitch waveform, and pitch waveforms corresponding to each pitch mark are averaged in a time region. The fused speech unit modification/connection section 274 modifies prosody of a fused speech unit, and connects the modified speech units. As a result, a speech waveform of synthesis speech is generated. As to the speech synthesis of the plural unit selection/fusion type, synthesized speech having higher stability than the unit selection type is acquired. Accordingly, in this component, speech by the target speaker's voice having high stability/naturalness can be synthesized.

(6) Modification Example 3

In the second embodiment, speech synthesis of the plural unit selection/fusion type having the speech unit database (previously created by applying the voice conversion rule) is explained. However, in the modification example 3, speech units are selected from the source speaker speech unit database, voice of the speech units is converted, a fused speech unit is generated by fusing the converted speech units, and speech is synthesized by modifying/connecting the fused speech units.

Figure 28:
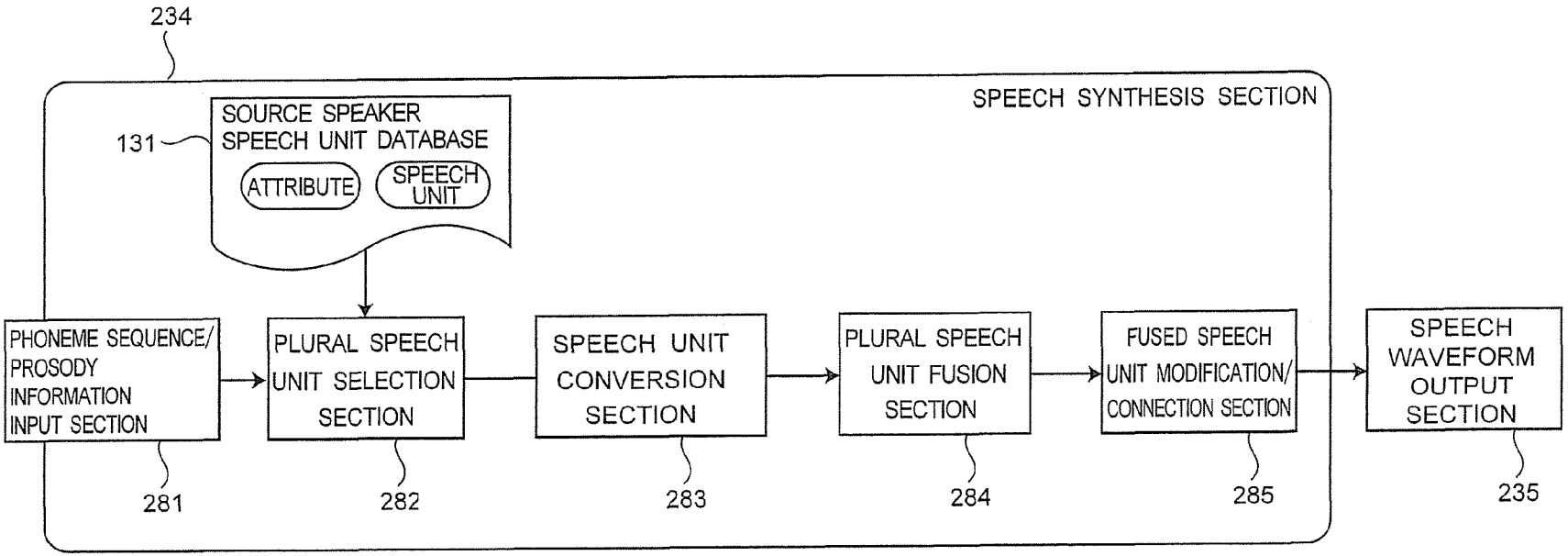
FIG. 28 is a schematic diagram of a third modification example of the speech synthesis section 234.

(6-1) Component:

As shown in FIG. 28, in addition to the source speaker speech unit database 131, the speech synthesis section 234 holds a voice conversion rule and a spectral compensation rule of the voice conversion apparatus of the first embodiment.

In case of speech synthesis, a phoneme sequence/prosody information input section 281 inputs a phoneme sequence and prosody information as a text analysis result. A plural speech unit selection section 282 selects speech units (for type of speech unit) from the source speaker speech unit database 131. A speech unit conversion section 283 converts the speech units to speech units having the target speaker's voice. Processing of the speech unit conversion section 283 is the same as the speech unit conversion section 1 in FIG. 1. Then, a plural speech unit fusion section 284 generates a fused speech unit by fusing the converted speech units. Last, a fused speech unit modification/connection section 285 modifies prosody of the fused speech unit and connects the modified speech units. In this way, synthesized speech is acquired.

(6-2) Effect:

In this component, calculation quantity of speech synthesis increases because voice conversion processing is necessary for speech synthesis. However, a voice of a synthesis speech is converted using the voice conversion rule. In case of generating a synthesis speech by a target speaker's voice, the target speaker speech unit database is not necessary.

Accordingly, in case of composing a speech synthesis system that synthesizes a speech by various speaker's voice, the source speaker speech unit database and a voice conversion rule of each speaker are only necessary. As a result, speech synthesis can be realized by memory quantity smaller than a speech unit database of all speakers.

Furthermore, in case of generating a conversion rule to a new speaker, only this conversion rule can be transmitted to another speech synthesis system via a network. Accordingly, in case of transmitting the new speaker's voice, all speech unit database of the new speaker need not be transmitted, and information quantity necessary for transmission can be reduced.

As to the speech synthesis of the plural unit selection/fusion type, a synthesis speech having higher stability than the unit selection type is acquired. In this component, speech by the target speaker's voice having high stability/naturalness can be synthesized.

(7) Modification Example 4

In the second embodiment, the voice conversion apparatus of the first embodiment is applied to speech synthesis of the unit selection type and the plural unit selection/fusion type. However, application of the voice conversion apparatus is not limited to this type.

For example, the voice conversion apparatus is applied to a speech synthesis apparatus based on closed loop training as one of speech synthesis of unit training type (Referred to in JP.No. 3281281).

In the speech synthesis of unit training type, a speech unit representing a plurality of speech units as training data is trained and held. By modifying/connecting the trained speech unit based on input phoneme sequence/prosody information, speech is synthesized. In this case, voice conversion can be applied by converting a speech unit (training data) and training a typical speech unit from the converted speech unit. Furthermore, by applying the voice conversion to the trained speech unit, a typical speech unit having the target speaker's voice can be created.

Furthermore, in the first and second embodiments, a speech unit is analyzed and synthesized based on pitch synchronization analysis. However, speech synthesis is not limited to this method. For example, pitch synchronization processing cannot be executed in an unvoiced sound segment because a pitch does not exist in the unvoiced sound segment. In this segment, a voice can be converted by analysis synthesis of fixed frame rate. In this case, the analysis synthesis of fixed frame rate can be used for not only the unvoiced sound segment but also another segment. Furthermore, a source speaker's speech unit may be used as itself without converting a speech unit of unvoiced sound.

In the disclosed embodiments, the processing can be accomplished by a computer-executable program, and this program can be realized in a computer-readable memory device.

In the embodiments, the memory device, such as a magnetic disk, a flexible disk, a hard disk, an optical disk (CD-ROM, CD-R, DVD, and so on), an optical magnetic disk (MD and so on) can be used to store instructions for causing a processor or a computer to perform the processes described above.

Furthermore, based on an indication of the program installed from the memory device to the computer, OS (operation system) operating on the computer, or MW (middle ware software) such as database management software or network, may execute one part of each processing to realize the embodiments.

Furthermore, the memory device is not limited to a device independent from the computer. By downloading a program transmitted through a LAN or the Internet, a memory device in which the program is stored is included. Furthermore, the memory device is not limited to one. In the case that the processing of the embodiments is executed by a plurality of memory devices, a plurality of memory devices may be included in the memory device. The component of the device may be arbitrarily composed.

A computer may execute each processing stage of the embodiments according to the program stored in the memory device. The computer may be one apparatus such as a personal computer or a system in which a plurality of processing apparatuses are connected through a network. Furthermore, the computer is not limited to a personal computer. Those skilled in the art will appreciate that a computer includes a processing unit in an information processor, a microcomputer, and so on. In short, the equipment and the apparatus that can execute the functions in embodiments using the program are generally called the computer.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. An apparatus for converting a source speaker's speech to a target speaker's speech, comprising:

a speech unit generation section configured to acquire speech units of the source speaker by segmenting the source speaker's speech;

a parameter calculation section configured to calculate spectral parameter vectors of each time in a speech unit, the each time being a predetermined time between a start time and an end time of the speech unit;

a conversion rule memory configured to store voice conversion rules and rule selection parameters each corresponding to a voice conversion rule, the voice conversion rule converting a spectral parameter vector of the source speaker to a spectral parameter vector of the target speaker, a rule selection parameter representing a feature of the spectral parameter vector of the source speaker;

a rule selection section configured to select a first voice conversion rule corresponding to a first rule selection parameter and a second voice conversion rule corresponding to a second rule selection parameter from the conversion rule memory, the first rule selection parameter being matched with a first spectral parameter vector of the start time, the second rule selection parameter vector being matched with a second spectral parameter of the end time;

an interpolation coefficient decision section configured to determine interpolation coefficients each corresponding to a third spectral parameter vector of the each time in the speech unit based on the first voice conversion rule and the second voice conversion rule;

a conversion rule generation section configured to generate third voice conversion rules each corresponding to the third spectral parameter vector of the each time in the speech unit by interpolating the first voice conversion rule and the second conversion rule with each of the interpolation coefficients;

a spectral parameter conversion section configured to respectively convert the third spectral parameter vector of the each time to a spectral parameter vector of the target speaker based on each of the third voice conversion rules;

a spectral compensation section configured to compensate a spectrum acquired from the converted spectral parameter of the target speaker by a spectral compensation filter or power ratio; and a speech waveform generation section configured to generate a speech waveform from the compensated spectrum.

2. The apparatus according to claim 1, further comprising:

a spectral compensation quantity calculation section configured to calculate the spectral compensation filter or power ratio by using a spectrum of each time of the source speaker and a converted spectrum of each time of the target speaker.

3. The apparatus according to claim 1, further comprising:

a conversion rule training section configured to train the voice conversion rule by using a speech unit of the source speaker and the target speaker's speech.

4. The apparatus according to claim 3, wherein the conversion rule training section comprises:

a source speaker speech unit memory configured to store a speech unit of the source speaker;

a target speaker speech unit generation section configured to acquire speech units of the target speaker by segmenting the target speaker's speech;

a rule selection parameter generation section configured to generate a rule selection parameter from a spectrum of each time of the speech unit of the source speaker;

a speech unit selection section configured to select the speech unit of the source speaker most similar to the speech unit of the target speaker from the source speaker speech unit memory;

a conversion rule generation section configured to generate a start point conversion rule and an end point conversion rule, the start point conversion rule representing conversion of a speech parameter of a start time of the speech unit of the source speaker, the end point conversion rule representing conversion of a speech parameter of an end time of the speech unit of the source speaker;

an interpolation coefficient determination section configured to determine interpolation coefficients each corresponding to a speech parameter of each time of the speech unit of the source speaker from the start point conversion rule and the end point conversion rule;

a parameter-pair generation section configured to generate a pair of each speech parameter of the speech unit of the target speaker and each speech parameter of the selected speech unit of the source speaker; and a conversion rule creation section configured to create a voice conversion rule from the generated pairs of speech parameters and the interpolation coefficient corresponding to the speech parameters.

5. The apparatus according to claim 1, wherein the rule selection parameter is a probability distribution of a spectral parameter vector corresponding to the voice conversion rule.

6. The apparatus according to claim 5, wherein the rule selection section comprises:

a component section configured to compose a hidden Markov model of left-right type from a first state probability distribution and a second state probability distribution, the first state probability distribution being the probability distribution corresponding to a spectral parameter vector of a start time of the speech unit of the source speaker, the second state probability distribution being the probability distribution corresponding to a spectral parameter vector of an end time of the speech unit of the source speaker;

a first rule selection section configured to select a voice conversion rule corresponding to the probability distribution of the start time as the first voice conversion rule from the conversion rule memory; and a second rule selection section configured to select a voice conversion rule corresponding to the probability distribution of the end time as the second voice conversion rule from the conversion rule memory.

7. The apparatus according to claim 6, wherein the interpolation coefficient decision section comprises:

a similarity calculation section configured to calculate a start point similarity and an end point similarity in the hidden Markov model, the start point similarity being a probability that the spectral parameter vector of each time in the speech unit is output at the first state, the end point similarity being a probability that the spectral parameter vector of each time in the speech unit is output at the second state; and a similarity set section configured to set a pair of the start point similarity and the end point similarity as the interpolation coefficient of the time.

8. The apparatus according to claim 1, wherein the conversion rule memory stores a typical spectral parameter vector corresponding to each voice conversion rule, the rule selection section respectively selects typical parameter vectors from spectral parameter vectors of the start time and the end time of the speech unit of the source speaker, and selects the voice conversion rule corresponding to the typical parameter vectors from the conversion rule memory as the first voice conversion rule and the second voice conversion rule, and the interpolation coefficient decision section determines the interpolation coefficient by linearly interpolating the first voice conversion rule and the second voice conversion rule.

9. The apparatus according to claim 1, wherein the spectral compensation section comprises:

a source speaker speech unit memory configured to store a speech unit of the source speaker;

a target speaker speech unit generation section configured to acquire speech units of the target speaker by segmenting the target speaker's speech;

a speech unit selection section configured to select the speech unit of the source speaker most similar to the speech unit of the target speaker from the source speaker speech unit memory;

a first average, spectral extraction section configured to calculate a first average spectrum by averaging a spectrum of each time of converted spectral parameter vector of the target speaker;

a second average spectral extraction section configured to calculate a second average spectrum by averaging a spectrum of each time of the speech unit of the target speaker; and a compensation quantity generation section configured to generate the spectral compensation filter or power ratio to compensate the first average spectrum to the second average spectrum.

10. The apparatus according to claim 1, wherein the spectral compensation section comprises:

a target power information extraction section configured to extract a target power information of a spectrum from the spectral parameter vector of the target speaker;

a source power information extraction section configured to extract a source power information of a spectrum from the spectral parameter vector of the source speaker;

a power information compensation quantity calculation section configured to calculate a power ratio based on the source power information to compensate the target power information; and a power compensation section configured to compensate the target power information using the power ratio.

11. The apparatus according to claim 10, wherein the target power information extraction section calculates the target power information of the spectrum of the target speaker compensated by the power ratio.

12. The apparatus according to claim 1, wherein the conversion rule comprises a regression matrix to predict the spectral parameter vector of the target speaker from the spectral parameter vector of the source speaker.

13. A speech synthesis apparatus comprising:

a synthesis unit segmentation section configured to segment a phoneme sequence of an input text into text units as a predetermined synthesis unit;

a source speaker speech unit memory configured to store speech units of the source speaker;

a source speaker speech unit selection section configured to select at least one speech unit corresponding to a text unit from the source speaker speech unit memory;

a speech unit generation section configured to generate a typical speech unit of the source speaker as the at least one speech unit;

a voice conversion section configured to convert the typical speech unit of the source speaker to a typical speech unit of the target speaker according to the apparatus of claim 1, and a synthesis speech waveform output section configured to output a synthesis speech waveform by concatenating the typical speech units of the target speaker.

14. The speech synthesis apparatus according to claim 13, wherein the speech unit generation section generates the typical speech unit of the source speaker by fusing a plurality of speech units corresponding to the text unit.

15. A speech synthesis apparatus comprising:

a source speaker speech unit memory configured to store speech units of the source speaker;

a voice conversion section configured to convert a typical speech unit of the source speaker to a typical speech unit of the target speaker according to the apparatus of claim 1, a target speaker speech unit memory configured to store the typical speech unit of the target speaker;

a synthesis unit segmentation section configured to segment a phoneme sequence of an input text into text units as a predetermined synthesis unit;

a target speaker speech unit selection section configured to select at least one speech unit corresponding to the text unit from the target speaker speech unit memory;

a speech unit generation section configured to generate a typical speech unit of the target speaker as the at least one speech unit; and a synthesis speech waveform output section configured to output a synthesis speech waveform by concatenating the typical speech units of the target speaker.

16. The speech synthesis apparatus according to claim 15, wherein the speech unit generation section generates the typical speech unit of the target speaker by fusing a plurality of typical speech units corresponding to the text unit.

17. A method for converting a source speaker's speech to a target speaker's speech, comprising:

storing voice conversion rules and rule selection parameters each corresponding to a voice conversion rule in a memory, the voice conversion rule converting a spectral parameter vector of the source speaker to a spectral parameter vector of the target speaker, a rule selection parameter representing a feature of the spectral parameter vector of the source speaker;

acquiring speech units of the source speaker by segmenting the source speaker's speech;

calculating spectral parameter vectors of each time in a speech unit, the each time being a predetermined time between a start time and an end time of the speech unit;

selecting a first voice conversion rule corresponding to a first rule selection parameter and a second voice conversion rule corresponding to a second rule selection parameter from the memory, the first rule selection parameter being matched with a first spectral parameter vector of the start time, the second rule selection parameter being matched with a second spectral parameter vector of the end time;

determining interpolation coefficients each corresponding to a third spectral parameter vector of the each time in the speech unit based on the first voice conversion rule and the second voice conversion rule;

generating third voice conversion rules each corresponding to the third spectral parameter vector of the each time in the speech unit by interpolating the first voice conversion rule and the second voice conversion rule with each of the interpolation coefficients;

converting the third spectral parameter vector of the each time to a spectral parameter vector of the target speaker based on each of the third voice conversion rules;

compensating a spectrum acquired from the converted spectral parameter vector of the target speaker by a spectral compensation filter or power ratio; and generating a speech waveform from the compensated spectrum.

18. A computer readable memory device storing program codes for causing a computer to convert a source speaker's speech to a target speaker's speech, the program codes comprising:

a first program code to correspondingly store voice conversion rules and rule selection parameters each corresponding to a voice conversion rule in a memory, the voice conversion rule converting a spectral parameter vector of the source speaker to a spectral parameter vector of the target speaker, a rule selection parameter representing a feature of the spectral parameter vector of the source speaker;

a second program code to acquire speech units of the source speaker by segmenting the source speaker's speech;

a third program code to calculate spectral parameter vectors of each time in a speech unit, the each time being a predetermined time between a start time and an end time of the speech unit;

a fourth program code to select a first voice conversion rule corresponding to a first rule selection parameter and a second voice conversion rule corresponding to a second rule selection parameter from the memory, the first rule selection parameter being matched with a first spectral parameter vector of the start time, the second rule selection parameter being matched with a second spectral parameter vector of the end time;

a fifth program code to decide interpolation coefficients each corresponding to a third spectral parameter vector of the each time in the speech unit based on the first voice conversion rule and the second voice conversion rule;

a sixth program code to generate third voice conversion rules each corresponding to the third spectral parameter vector of the each time in the speech unit by interpolating the first voice conversion rule and the second voice conversion rule with each of the interpolation coefficients;

a seventh program code to convert the third spectral parameter vector of the each time to a spectral parameter vector of the target speaker based on each of the third voice conversion rules;

an eighth program code to compensate a spectrum acquired from the converted spectral parameter of the target speaker by a spectral compensation filter or power ratio; and a ninth program code to generate a speech waveform from the compensated spectrum.

* * * * *